US010027025B2

(12) United States Patent
Tsai et al.

(10) Patent No.: US 10,027,025 B2
(45) Date of Patent: Jul. 17, 2018

(54) MOBILE DEVICE AND ANTENNA STRUCTURE THEREIN

(71) Applicant: HTC Corporation, Taoyuan, Taoyuan County (TW)

(72) Inventors: Tiao-Hsing Tsai, Taipei (TW); Chien-Pin Chiu, Taipei (TW); Wei-Yang Wu, Taoyuan (TW); Hsiao-Wei Wu, Taoyuan (TW)

(73) Assignee: HTC CORPORATION, Taoyuan (TW)

( * ) Notice: Subject to any disclaimer, the term of this patent is extended or adjusted under 35 U.S.C. 154(b) by 137 days.

(21) Appl. No.: 13/939,856

(22) Filed: Jul. 11, 2013

(65) Prior Publication Data

US 2014/0062815 A1 Mar. 6, 2014

Related U.S. Application Data

(63) Continuation-in-part of application No. 13/598,317, filed on Aug. 29, 2012.

(51) Int. Cl.

| | |
|---|---|
| ***H01Q 1/50*** | (2006.01) |
| ***H01Q 5/335*** | (2015.01) |
| ***H01Q 5/50*** | (2015.01) |
| ***H01Q 13/10*** | (2006.01) |
| ***H01Q 1/24*** | (2006.01) |

(Continued)

(52) U.S. Cl.

CPC ..... *H01Q 1/50* (2013.01); *H01Q 1/243* (2013.01); *H01Q 5/335* (2015.01); *H01Q 5/50* (2015.01); *H01Q 9/0442* (2013.01); *H01Q 9/42* (2013.01); *H01Q 13/103* (2013.01)

(58) Field of Classification Search

CPC ..... H01Q 1/50; H01Q 1/243; H01Q 5/335; H01Q 5/50; H01Q 9/0442; H01Q 13/103

See application file for complete search history.

(56) References Cited

U.S. PATENT DOCUMENTS

| | | | | |
|---|---|---|---|---|
| 6,515,629 | B1 | 2/2003 | Kuo et al. | |
| 7,518,564 | B2 | 4/2009 | Guthrie | |
| 9,270,012 | B2 * | 2/2016 | Nickel | H01Q 5/328 |

(Continued)

FOREIGN PATENT DOCUMENTS

| | | | |
|---|---|---|---|
| CN | 1377102 | A | 10/2002 |
| CN | 1412888 | A | 4/2003 |

(Continued)

OTHER PUBLICATIONS

U.S. Office Action, dated Sep. 11, 2015, for U.S. Appl. No. 13/598,317.

*Primary Examiner* — Jessica Han
*Assistant Examiner* — Amal Patel
(74) *Attorney, Agent, or Firm* — Birch, Stewart, Kolasch & Birch, LLP

(57) ABSTRACT

A mobile device includes an antenna structure, a signal source, a tunable circuit element, and a tuner. The antenna structure includes a radiation element. The tunable circuit element is coupled to the radiation element. The antenna structure and the tunable circuit element are disposed in a clearance region of the mobile device. The tuner has a variable impedance value, and is coupled between the tunable circuit element and the signal source. The tuner and the signal source are disposed in a circuit board region of the mobile device.

13 Claims, 22 Drawing Sheets

(51) Int. Cl.
*H01Q 9/04* (2006.01)
*H01Q 9/42* (2006.01)

(56) References Cited

U.S. PATENT DOCUMENTS

| | | | |
|---|---|---|---|
| 2001/0050637 | A1 | 12/2001 | Aoyama et al. |
| 2002/0135525 | A1 | 9/2002 | Ikegaya et al. |
| 2003/0122721 | A1 | 7/2003 | Sievenpiper |
| 2004/0246188 | A1 | 12/2004 | Egashira |
| 2004/0257283 | A1 | 12/2004 | Asano et al. |
| 2005/0007291 | A1 | 1/2005 | Fabrega-Sanchez et al. |
| 2005/0085204 | A1 | 4/2005 | Poilasne et al. |
| 2006/0197711 | A1 | 9/2006 | Sekiguchi et al. |
| 2007/0069957 | A1 | 3/2007 | Ranta |
| 2009/0079647 | A1 | 3/2009 | Jung et al. |
| 2009/0121961 | A1 | 5/2009 | Sangawa |
| 2009/0167617 | A1 | 7/2009 | Nishio |
| 2010/0026596 | A1 | 2/2010 | Nishio et al. |
| 2010/0060531 | A1 | 3/2010 | Rappaport |
| 2010/0073247 | A1 | 3/2010 | Arkko et al. |
| 2010/0149052 | A1 | 6/2010 | Nishio et al. |
| 2010/0289708 | A1 | 11/2010 | Bungo et al. |
| 2010/0302106 | A1 | 12/2010 | Knudsen et al. |
| 2010/0316246 | A1 | 12/2010 | Cho et al. |
| 2011/0134011 | A1 | 6/2011 | Yamagajo |
| 2011/0136447 | A1 | 6/2011 | Pascolini et al. |
| 2012/0009983 | A1* | 1/2012 | Mow et al. ..... 455/575.7 |
| 2012/0214421 | A1 | 8/2012 | Hoirup et al. |
| 2012/0231750 | A1* | 9/2012 | Jin ..... H01Q 7/005 455/77 |
| 2012/0280890 | A1 | 11/2012 | Kusumoto |

FOREIGN PATENT DOCUMENTS

| | | | |
|---|---|---|---|
| CN | 1745500 | A | 3/2006 |
| CN | 1778049 | A | 5/2006 |
| CN | 1926720 | A | 3/2007 |
| CN | 101002362 | A | 7/2007 |
| CN | 101488772 | A | 7/2009 |
| CN | 202025842 | U | 11/2011 |
| CN | 102377025 | A | 3/2012 |
| CN | 102394372 | A | 3/2012 |
| DE | 10 2008 050 743 | A1 | 4/2010 |
| EP | 0 613 209 | A1 | 8/1994 |
| EP | 0 869 579 | A1 | 10/1998 |
| EP | 1422787 | A1 | 5/2004 |
| EP | 1445823 | A1 | 8/2004 |
| EP | 1703586 | A1 | 9/2006 |
| EP | 2 405 534 | A1 | 1/2012 |
| EP | 2 434 652 | A1 | 3/2012 |
| TW | 200952252 | A | 12/2009 |
| TW | 201216561 | A1 | 4/2012 |
| WO | WO 00/38475 | A2 | 6/2000 |
| WO | WO 03/003505 | A1 | 1/2003 |
| WO | WO 2005/062416 | A1 | 7/2005 |
| WO | WO 2006/030708 | A1 | 3/2006 |
| WO | WO 2008/012355 | A1 | 1/2008 |
| WO | WO 2009/027182 | A1 | 3/2009 |
| WO | WO 2010/040752 | A1 | 4/2010 |
| WO | WO 2011/073056 | A1 | 6/2011 |
| WO | WO 2011/086723 | A1 | 7/2011 |

* cited by examiner

MOBILE DEVICE AND ANTENNA STRUCTURE THEREIN

CROSS REFERENCE TO RELATED APPLICATIONS

This application is a Continuation-In-Part of application Ser. No. 13/598,317, filed on Aug. 29, 2012, the entirety of which is incorporated by reference herein.

BACKGROUND OF THE INVENTION

Field of the Invention

The subject application generally relates to a mobile device, and more particularly, relates to a mobile device comprising a multi-band antenna structure.

Description of the Related Art

With the progress of mobile communication technology, handheld devices, for example, portable computers, mobile phones, multimedia players, and other hybrid functional portable electronic devices, have become more common. To satisfy the demand of users, handheld devices usually can perform wireless communication functions. Some devices cover a large wireless communication area, for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area, for example, mobile phones using Wi-Fi, Bluetooth, and WiMAX (Worldwide Interoperability for Microwave Access) systems and using frequency bands of 2.4 GHz, 3.5 GHz, 5.2 GHz, and 5.8 GHz.

A mobile phone usually has a limited amount of inner space. However, more and more antennas should be arranged in the mobile phone to operate in different bands. The number of electronic components other than the antennas, in the mobile phone, has not been reduced. Accordingly, each antenna is close to the electronic components, negatively affecting the antenna efficiency and bandwidths thereof.

BRIEF SUMMARY OF THE INVENTION

In one exemplary embodiment, the subject application is directed to a mobile device, comprising: an antenna structure, comprising a radiation element; a signal source; a tunable circuit element, coupled to the radiation element, wherein the antenna structure and the tunable circuit element are disposed in a clearance region of the mobile device; and a tuner, having a variable impedance value, and coupled between the tunable circuit element and the signal source, wherein the tuner and the signal source are disposed in a circuit board region of the mobile device.

BRIEF DESCRIPTION OF DRAWINGS

The subject application can be more fully understood by reading the subsequent detailed description and examples with references made to the accompanying drawings, wherein.

DETAILED DESCRIPTION OF THE INVENTION

Figure 1:
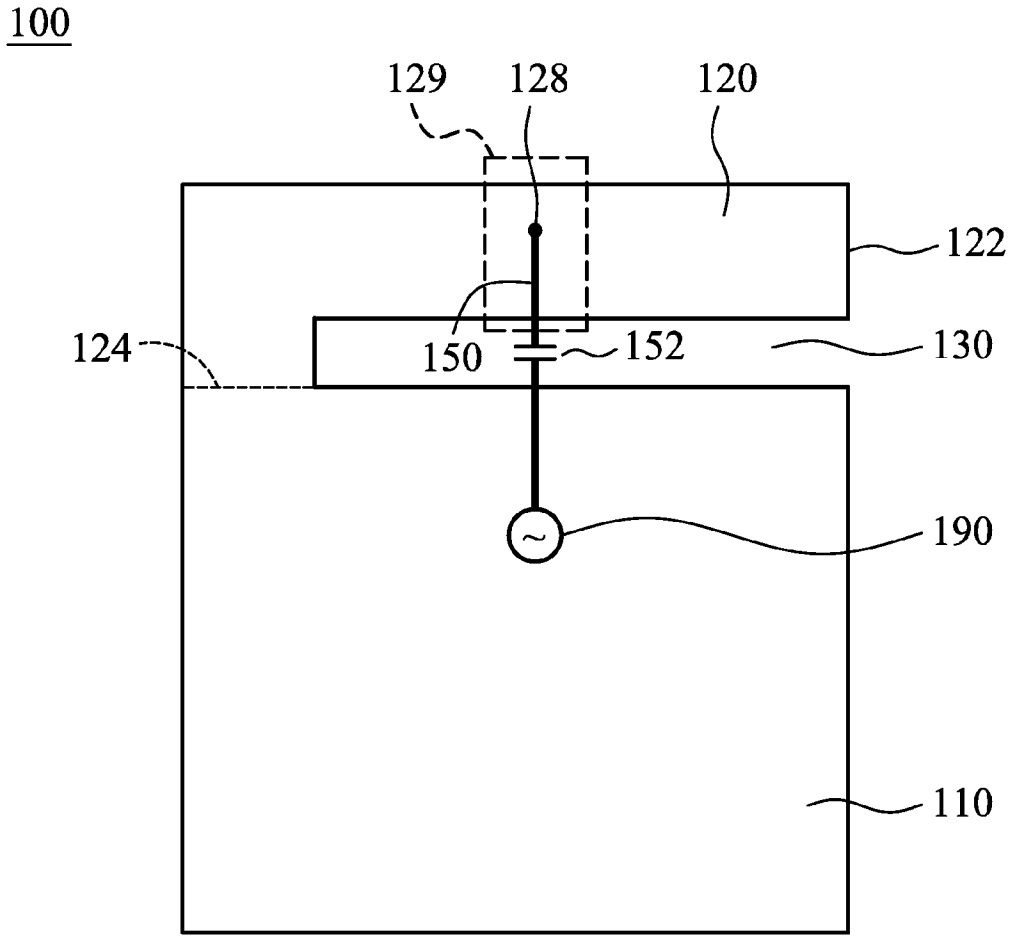
FIG. 1 is a diagram for illustrating a mobile device according to a first embodiment of the invention.

FIG. 1 is a diagram for illustrating a mobile device 100 according to a first embodiment of the invention. The mobile device 100 may be a cellular phone, a tablet computer, or a notebook computer. As shown in FIG. 1, the mobile device 100 at least comprises a ground plane 110, a grounding branch 120, and a feeding element 150. In some embodiments, the ground plane 110, the grounding branch 120, and the feeding element 150 are all made of conductive materials, such as silver, copper, or aluminum. The mobile device 100 may further comprise other essential components, for example, at least one housing, a touch input module, a display module, an RF (Radio Frequency) module, a processing module, a control module, and a power supply module (not shown).

The grounding branch 120 is coupled to the ground plane 110, wherein a slot 130 is formed between the ground plane 110 and the grounding branch 120. In the embodiment, the grounding branch 120 has an open end 122 and a grounding end 124, and the grounding end 124 is coupled to the ground plane 110. The grounding branch 120 may substantially have an L-shape. Note that the invention is not limited to the above. In other embodiments, the grounding branch 120 may have other shapes, such as a T-shape, an I-shape, or a U-shape.

The feeding element 150 extends across the slot 130, and is coupled between the grounding branch 120 and a signal source 190. In some embodiments, the feeding element 150 and the ground plane 110 are disposed on different planes. An antenna structure is formed by the grounding branch 120 and the feeding element 150. The feeding element 150 may further comprise a capacitor 152, which is coupled between a feeding point 128 located on the grounding branch 120 and the signal source 190. In a preferred embodiment, the capacitor 152 has a smaller capacitance and provides higher input impedance. The capacitor 152 may be a general capacitor or a variable capacitor. By adjusting the capacitance of the capacitor 152, the antenna structure may be excited to generate one or more operation bands. The capacitor 152 may substantially lie on the slot 130 (as shown in FIG. 1), or be substantially located on the grounding branch 120.

More particularly, the feeding element 150 is coupled to the feeding point 128 located on the grounding branch 120, wherein the feeding point 128 is away from the grounding end 124 of the grounding branch 120. It is understood that in a traditional PIFA (Planar Inverted-F Antenna), a feeding point is usually very close to a grounding end. In some embodiments, the feeding point 128 is substantially located on a middle region 129 of the grounding branch 120. When a user holds the mobile device 100, a palm and a head of the user is close to the edges of the ground plane 110 and the grounding branch 120. Therefore, if the feeding point 128 is located on the middle region 129 of the grounding branch 120, the antenna structure will be not influenced by the user so much. In a preferred embodiment, except for the feeding element 150 and the capacitor 152, there is no conductive component (e.g., metal traces and copper foils) extending across the slot 130 and its vertical projection plane.

Figure 2:
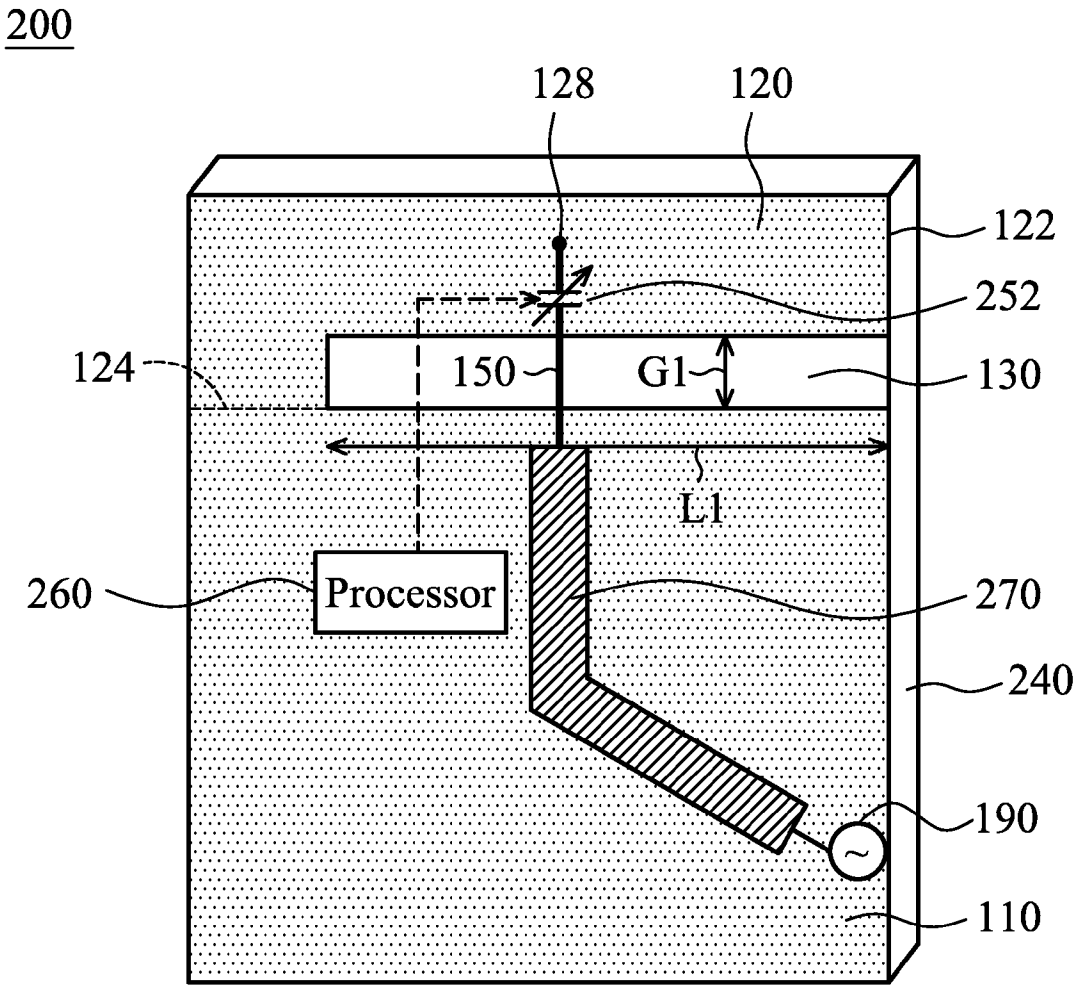
FIG. 2 is a diagram for illustrating a mobile device according to a second embodiment of the invention.

FIG. 2 is a diagram for illustrating a mobile device 200 according to a second embodiment of the invention. In comparison to FIG. 1, the mobile device 200 further comprises a dielectric substrate 240, a processor 260, and/or a coaxial cable 270. The dielectric substrate 240 may be an FR4 substrate or a hard and flexible composite substrate. The ground plane 110 and the grounding branch 120 are both disposed on the dielectric substrate 240. In the embodiment, the feeding element 150 comprises a variable capacitor 252. Similarly, the variable capacitor 252 may substantially lie on the slot 130, or be substantially located on the grounding branch 120 (as shown in FIG. 2), thereby electrically connecting the antenna structure of the mobile device 200. The processor 260 can adjust a capacitance of the variable capacitor 252. In some embodiments, the processor 260 adjusts the capacitance of the variable capacitor 252 according to an operation state of the mobile device in such a manner that the antenna structure of the mobile device 200 can operate in different bands. In addition, the coaxial cable 270 is coupled between the feeding element 150 and the signal source 190. As described above in FIG. 1, except for the feeding element 150 and the capacitor 152, there is no conductive component (e.g., metal traces and copper foils) extending across the slot 130 and its vertical projection plane. In some embodiments, the slot 130 is either formed through the dielectric substrate 240 or not formed through the dielectric substrate 240. If there is no other conductive component disposed in the slot 130 and its vertical projection plane, the antenna structure can have good antenna efficiency and bandwidth.

Figures 3A, 3B, 3C:
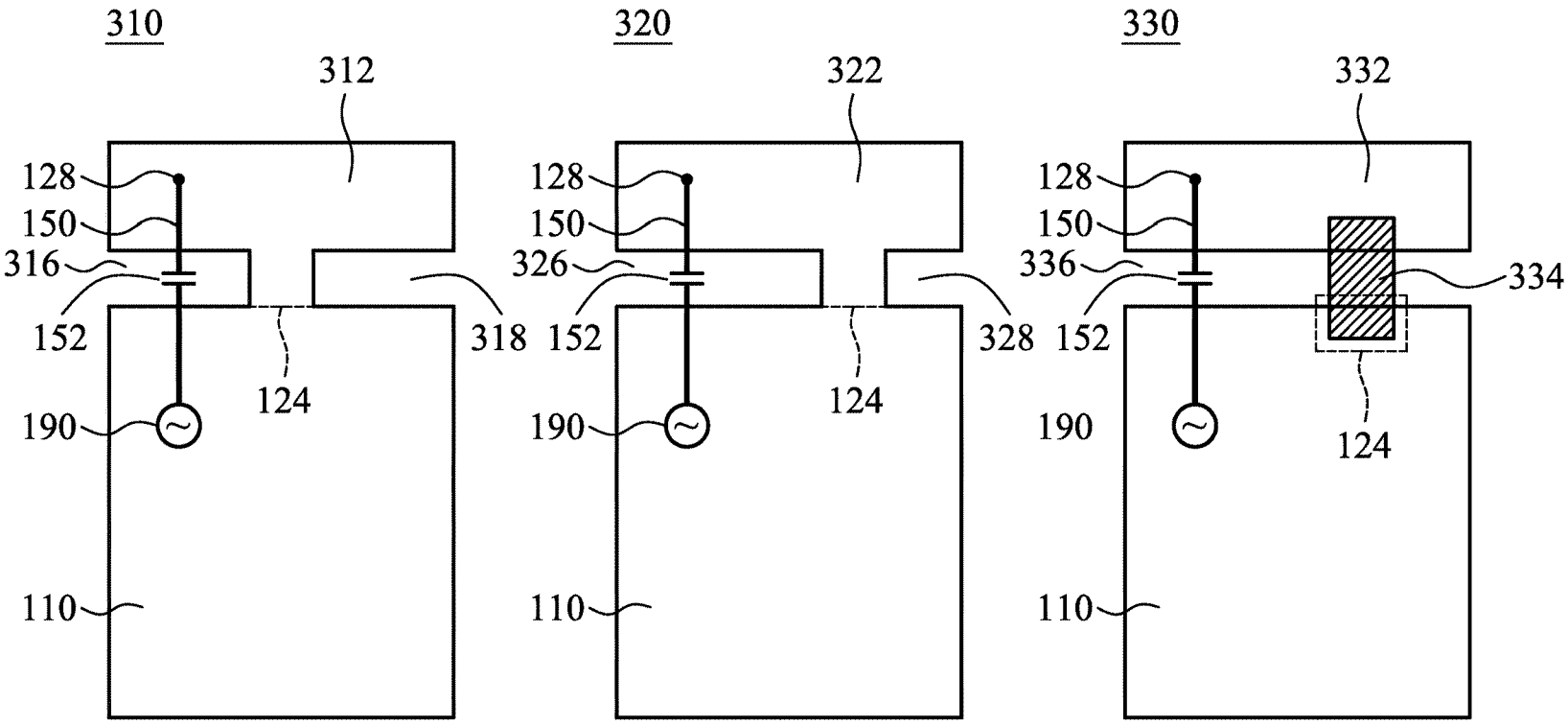
FIG. 3A is a diagram for illustrating a mobile device according to a third embodiment of the invention.
FIG. 3B is a diagram for illustrating a mobile device according to a fourth embodiment of the invention.
FIG. 3C is a diagram for illustrating a mobile device according to a fifth embodiment of the invention.

FIG. 3A is a diagram for illustrating a mobile device 310 according to a third embodiment of the invention. The mobile device 310 in the third embodiment is similar to the mobile device 100 in the first embodiment. The difference between the two embodiments is that the two slots 316 and 318 are formed between the ground plane 110 and a grounding branch 312 in the mobile device 310, wherein the grounding branch 312 substantially has a T-shape. The slot 316 is substantially separated from the slot 318. The feeding element 150 may extend across one of the slots 316 and 318 to excite an antenna structure of the mobile device 310. In the embodiment, the slots 316 and 318 are substantially aligned in a same straight line, and the length of the slot 316 is substantially equal to the length of the slot 318.

FIG. 3B is a diagram for illustrating a mobile device 320 according to a fourth embodiment of the invention. The mobile device 320 in the fourth embodiment is similar to the mobile device 100 in the first embodiment. The difference between the two embodiments is that the two slots 326 and 328 are formed between the ground plane 110 and a grounding branch 322 in the mobile device 320, wherein the grounding branch 322 substantially has a T-shape. The slot 326 is substantially separated from the slot 328. The feeding element 150 may extend across one of the slots 326 and 328 to excite an antenna structure of the mobile device 320. In the embodiment, the slots 326 and 328 are substantially aligned in a same straight line, and the length of the slot 326 is greater than the length of the slot 328. In other embodiments, the length of the slot 326 is changed to be smaller than the length of the slot 328.

FIG. 3C is a diagram for illustrating a mobile device 330 according to a fifth embodiment of the invention. The mobile device 330 in the fifth embodiment is similar to the mobile device 100 in the first embodiment. The difference between the two embodiments is that the mobile device 330 further comprises an FPCB (flexible printed circuit board) 334, and a slot 336 separates the ground plane 110 from a grounding branch 332 completely, wherein the grounding branch 332 substantially has an I-shape. The feeding element 150 may extend across the slot 336 to excite an antenna structure of the mobile device 330. In the embodiment, since the grounding branch 332 is coupled through the FPCB 334 to a grounding end 124 of the ground plane 110, thus the FPCB 334 may be considered as a portion of the antenna structure. Therefore, the FPCB 334 does not influence the radiation performance of the antenna structure very much.

Figure 4:
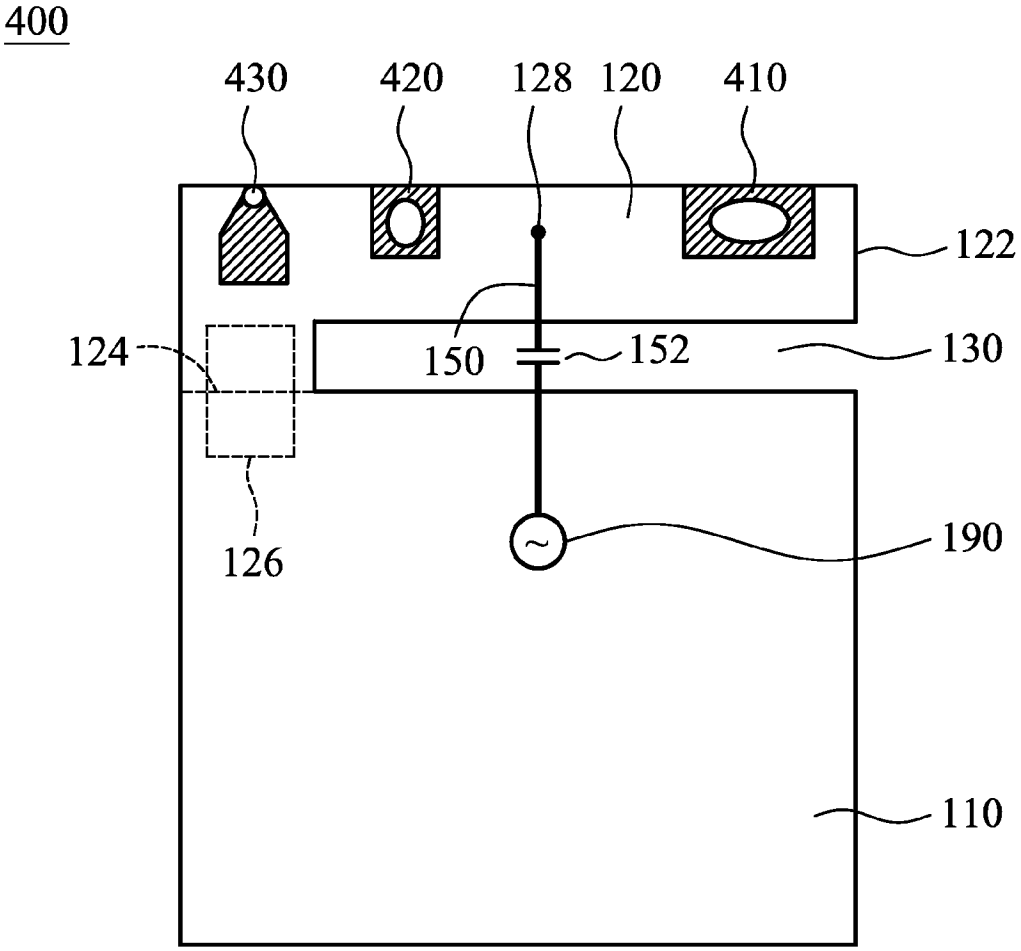
FIG. 4 is a diagram for illustrating a mobile device according to a sixth embodiment of the invention.

FIG. 4 is a diagram for illustrating a mobile device 400 according to a sixth embodiment of the invention. The mobile device 400 in the sixth embodiment is similar to the mobile device 100 in the first embodiment. The difference between the two embodiments is that the mobile device 400 further comprises one or more electronic components, for example, a speaker 410, a camera 420, and/or a headphone jack 430. The one or more electronic components are disposed on the grounding branch 120 of an antenna structure of the mobile device 400, to electrically connect the antenna structure of the mobile device 400, and may be considered as a portion of the antenna structure. Accordingly, the one or more electronic components do not influence the radiation performance of the antenna structure very much. In the embodiment, the antenna region may load the one or more electronic components and may be integrated therewith, appropriately, thereby saving inner design space of the mobile device 400. Note that the one or more electronic components would all be coupled through a wiring region 126 to a processing module and a control module (not shown).

Figure 5:
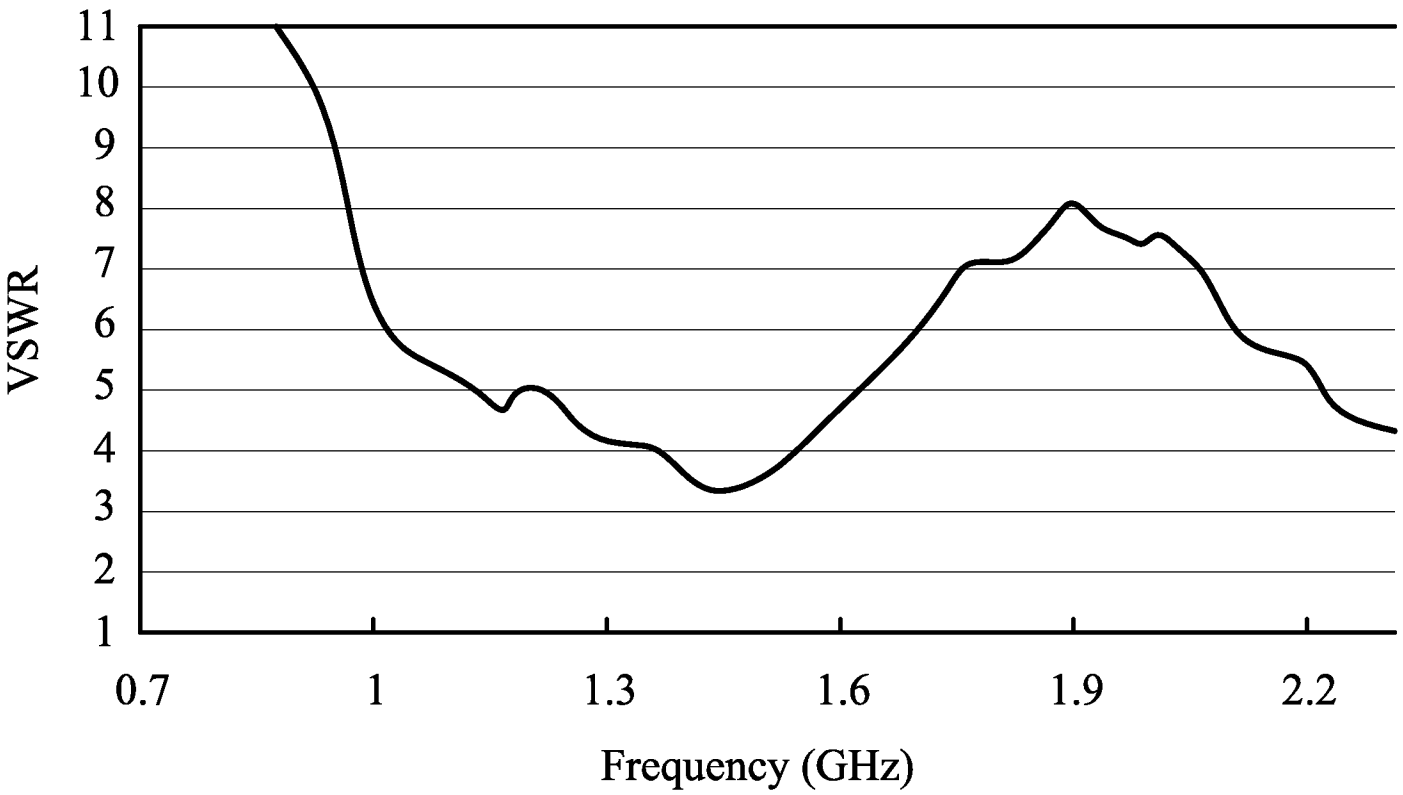
FIG. 5 is a diagram for illustrating a VSWR (Voltage Standing Wave Ratio) of a mobile device without any variable capacitors according to the second embodiment of the invention.

FIG. 5 is a diagram for illustrating a VSWR (Voltage Standing Wave Ratio) of the mobile device 200 without the variable capacitor 252 according to the second embodiment of the invention. The horizontal axis represents operation frequency (GHz), and the vertical axis represents the VSWR. As shown in FIG. 5, when the variable capacitor 252 is removed from the mobile device 200, the antenna structure of the mobile device 200 merely covers a single band, and the band cannot be adjusted easily.

Figure 6:
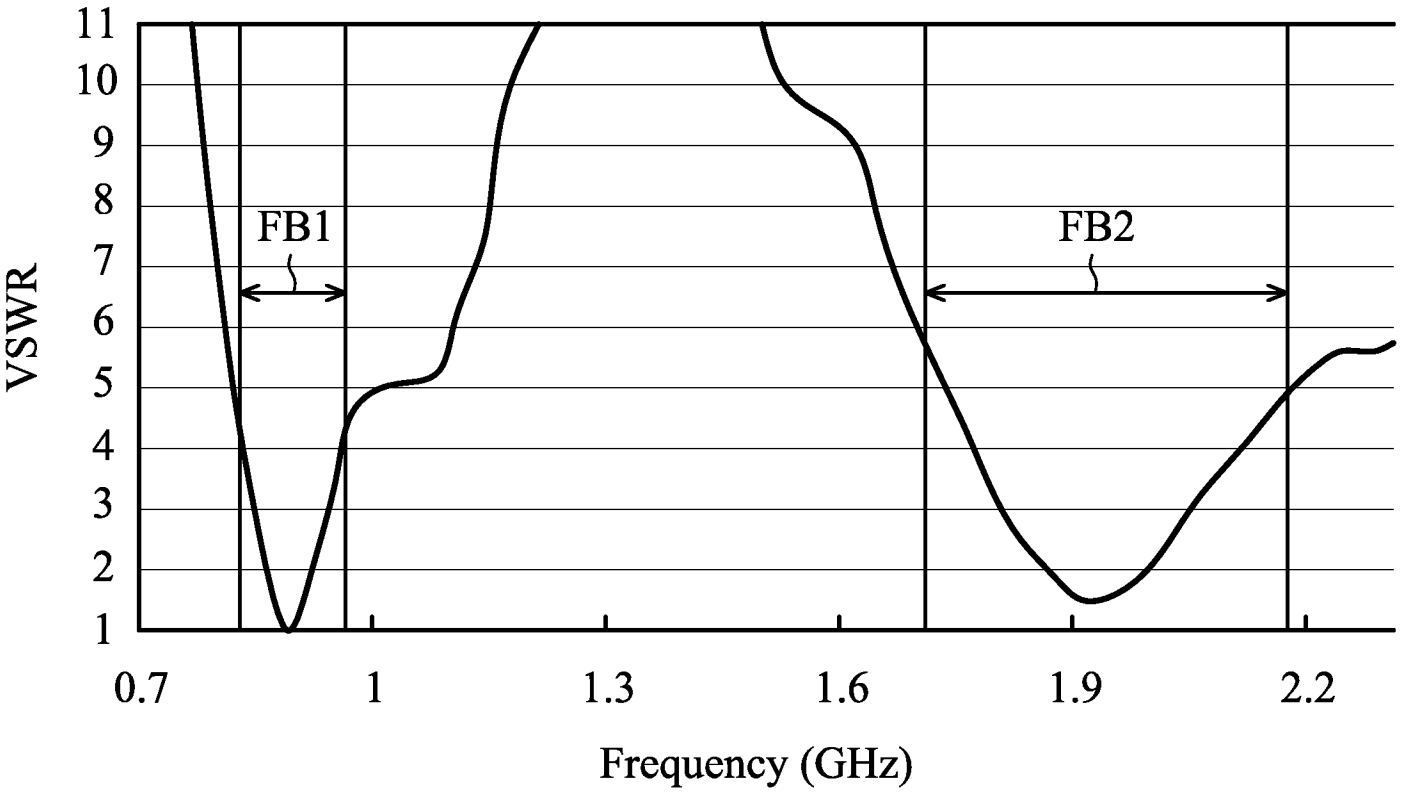
FIG. 6 is a diagram for illustrating a VSWR of a mobile device with a variable capacitor according to the second embodiment of the invention.

FIG. 6 is a diagram for illustrating a VSWR of the mobile device 200 with the variable capacitor 252 according to the second embodiment of the invention. The horizontal axis represents operation frequency (GHz), and the vertical axis represents the VSWR. As shown in FIG. 6, when the antenna structure of the mobile device 200 is fed through the feeding element 150 comprising the variable capacitor 252, the antenna structure is excited to generate a first band FB1 and a second band FB2. In a preferred embodiment, the first band FB1 is approximately from 824 MHz to 960 MHz, and the second band FB2 is approximately from 1710 MHz to 2170 MHz. By adjusting the capacitance of the variable capacitor 252, the antenna structure can cover multiple bands and control the frequency ranges of the bands easily.

Refer back to FIG. 2. Theoretically, the antenna structure of the mobile device 200 mainly has two resonant paths. A first resonant path is from the grounding end 124 of the grounding branch 120 through the feeding point 128 to the open end 122 of the grounding branch 120. A second resonant path is from the feeding point 128 to the open end 122 of the grounding branch 120. In some embodiments, the longer first resonant path is excited to generate the lower first band FB1, and the shorter second resonant path is excited to generate the higher second band FB2. The frequency range of the first band FB1 is controlled by changing the capacitance of the variable capacitor 252 and by changing the length L1 of the slot 130. The frequency range of the second band FB2 is controlled by changing the distance between the feeding point 128 and the grounding end 124. The bandwidth between the first band FB1 and the second band FB2 is controlled by changing the width G1 of the slot 130. For the low band, since the feeding point 128 is away from the grounding end 124 of the grounding branch 120, the total impedance of the antenna structure rises. When the capacitor 152 with a small capacitance is coupled to the feeding element 150, a feeding structure with higher impedance is formed. The small capacitance does not influence the high band much such that the antenna structure can maintain resonant modes in the high band to generate multiple bands. On the contrary, when another capacitor with a large capacitance is coupled to the feeding element 150, the resonant modes of the antenna structure in the low band are influenced such that the antenna structure cannot operate in specific multiple bands.

In an embodiment, the element sizes and the element parameters are as follows. The length of the ground plane 110 is approximately equal to 108 mm. The width of the ground plane 110 is approximately equal to 60 mm. The thickness of the dielectric substrate 240 is approximately equal to 0.8 mm. The length L1 of the slot 130 is approximately from 45 mm to 57 mm. The width G1 of the slot 130 is approximately from 0.6 mm to 2.5 mm. The largest capacitance of the variable capacitor 252 is about three times that of the smallest capacitance thereof. For example, the capacitance of the variable capacitor 252 is approximately from 0.5 pF to 1.5 pF, or is approximately from 0.9 pF to 2.7 pF. In other embodiments, the variable capacitor 252 may be replaced with a general capacitor. After the measurement, the antenna efficiency of the antenna structure is greater than 49.7% in the first band FB1, and is greater than 35.3% in the second band FB2.

In the embodiments of FIGS. 1-4, the antenna structure of the mobile device is fed through the capacitor to the high impedance environment, and thus, the antenna structure can operate in multiple bands. Since the feeding point of the antenna structure is away from the grounding end of the ground plane, the antenna structure can maintain good radiation performance even if a user is close to the antenna structure. In addition, the antenna structure may be used to load some electronic components, thereby saving inner design space of the mobile device.

Figure 7:
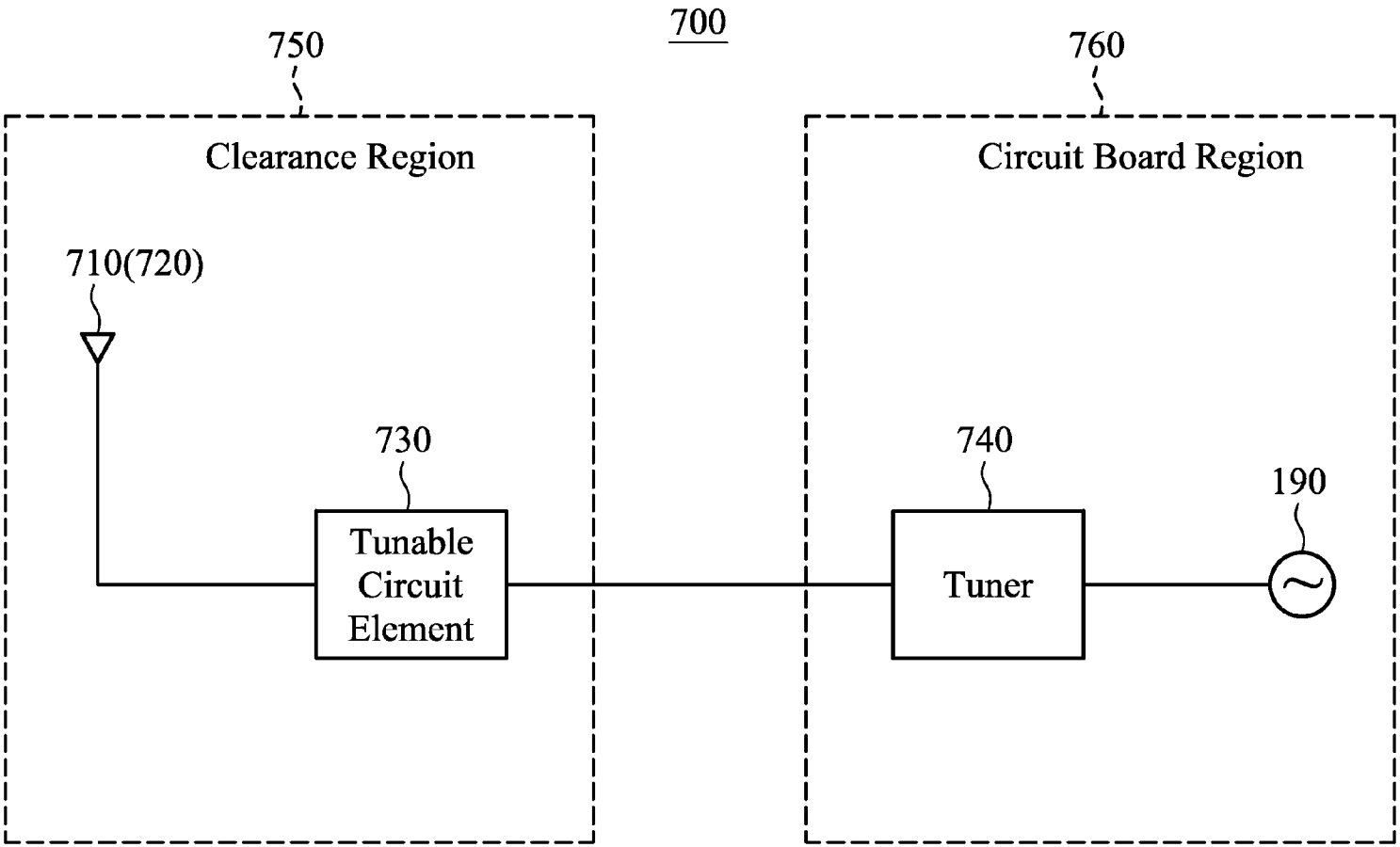
FIG. 7 is a diagram for illustrating a mobile device according to a seventh embodiment of the invention.

FIG. 7 is a diagram for illustrating a mobile device 700 according to a seventh embodiment of the invention. The mobile device 700 may be a cellular phone, a tablet computer, or a notebook computer. As shown in FIG. 7, the mobile device 700 at least comprises an antenna structure 710, a tunable circuit element 730, a tuner 740, and a signal source 190. The type of the antenna structure 710 is not limited in the invention. For example, the antenna structure 710 may comprise a monopole antenna, a dipole antenna, a loop antenna, a PIFA (Planar Inverted F Antenna), a patch antenna, or a chip antenna. In a preferred embodiment, the antenna structure 710 at least comprises a radiation element 720. The radiation element 720 is made of a conductive material, for example, silver, copper, or aluminum. The radiation element 720 may have any shape, for example, a straight-line shape, an L-shape, a U-shape, or an S-shape. The signal source 190 may be an RF (Radio Frequency) module configured to generate an RF signal to excite the antenna structure 710. Note that the mobile device 700 may further comprise other essential components, for example, at least one housing, a touch input module, a display module, an RF module, a processing module, a control module, and a power supply module (not shown).

The inner space of the mobile device 700 may be divided into a clearance region 750 and a circuit board region 760. The clearance region 750 is preferably a no-metal region to avoid interference with the radiation performance of the antenna structure 710. The circuit board region 760 is mainly configured to accommodate a system circuit board, a plurality of metal traces, and a variety of metal components. The circuit board region 760 may further comprise a ground plane of the mobile device 700, and the circuit board region 760 and the ground plane are disposed on a dielectric substrate (not shown). In a preferred embodiment, the antenna structure 710 and the tunable circuit element 730 are disposed in the clearance region 750 of the mobile device 700 to form an antenna assembly. A processor (not shown), the tuner 740, and the signal source 190 are disposed in the circuit board region 760 of the mobile device 700. The processor is configured to adjust the tunable circuit element 730 and the tuner 740, to excite and control the antenna assembly, such that the mobile device 700 is capable of operating in different bands.

The tunable circuit element 730 is coupled to the radiation element 720. In some embodiments, the tunable circuit element 730 is implemented with a variable capacitor and/or a variable inductor. The tuner 740 has a variable impedance value, and is coupled between the tunable circuit element 730 and the signal source 190 and configured to adjust the impedance matching of the antenna structure 710. In some embodiments, the tuner 740 comprises one or more variable capacitors, variable inductors, and switches. The mobile device 700 may further comprise a processor (not shown). The processor is configured to control the impedance values of the tunable circuit element 730 and the tuner 740, such that the antenna structure 710 is capable of operating in different bands.

Figure 8A:
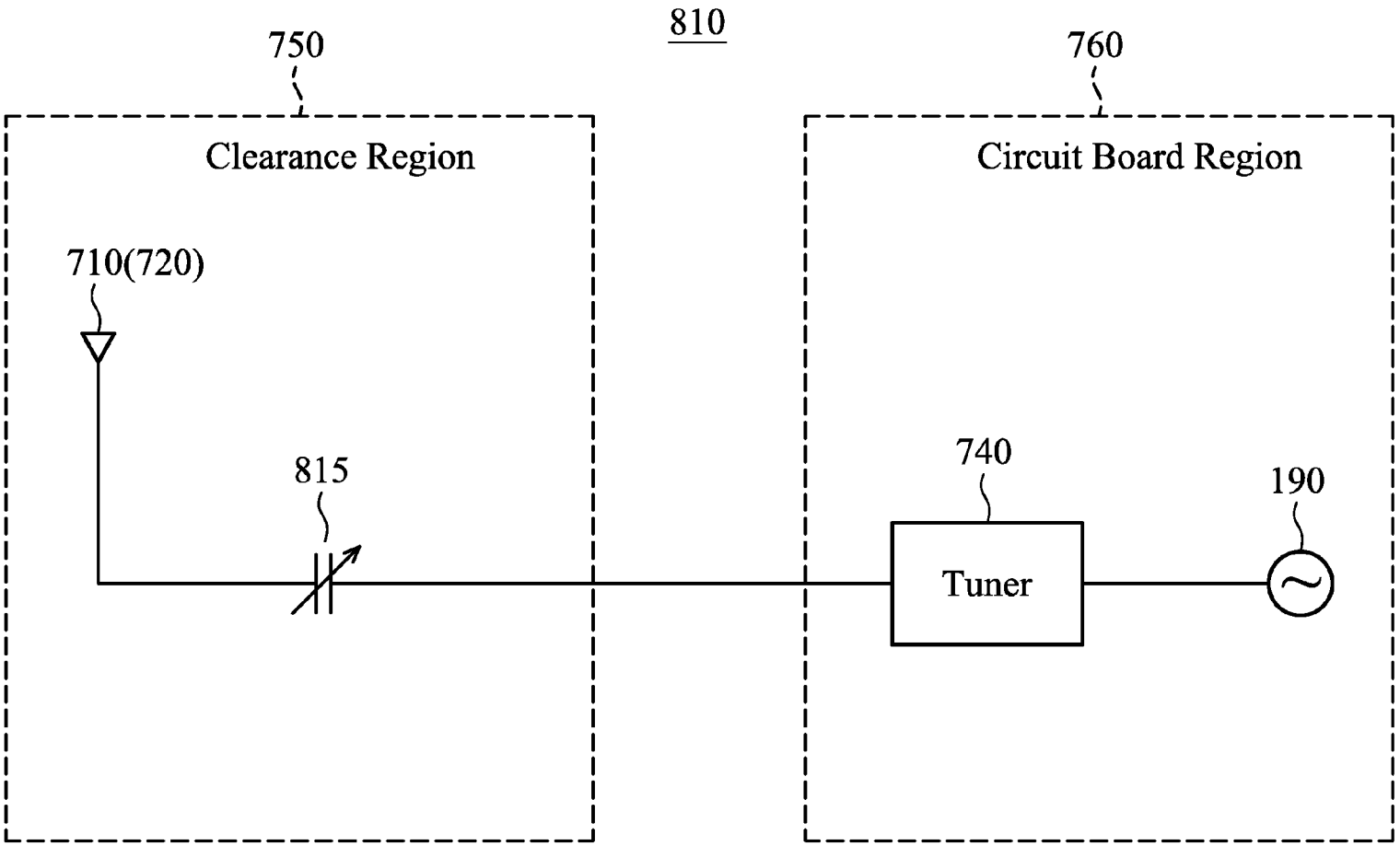
FIG. 8A is a diagram for illustrating a mobile device according to an eighth embodiment of the invention.

FIG. 8A is a diagram for illustrating a mobile device 810 according to an eighth embodiment of the invention. The mobile device 810 of the eighth embodiment is similar to the mobile device 700 of the seventh embodiment. In the mobile device 810, the aforementioned tunable circuit element 730 comprises a variable capacitor 815. A first terminal of the variable capacitor 815 is coupled to the radiation element 720, and a second terminal of the variable capacitor 815 is coupled to the tuner 740. By adjusting a capacitance of the variable capacitor 815 and/or the variable impedance value of the tuner 740, the antenna structure 710 of the mobile device 810 is excited and capable of generating multiple bands so as to achieve the desired wideband operation.

Figure 8B:
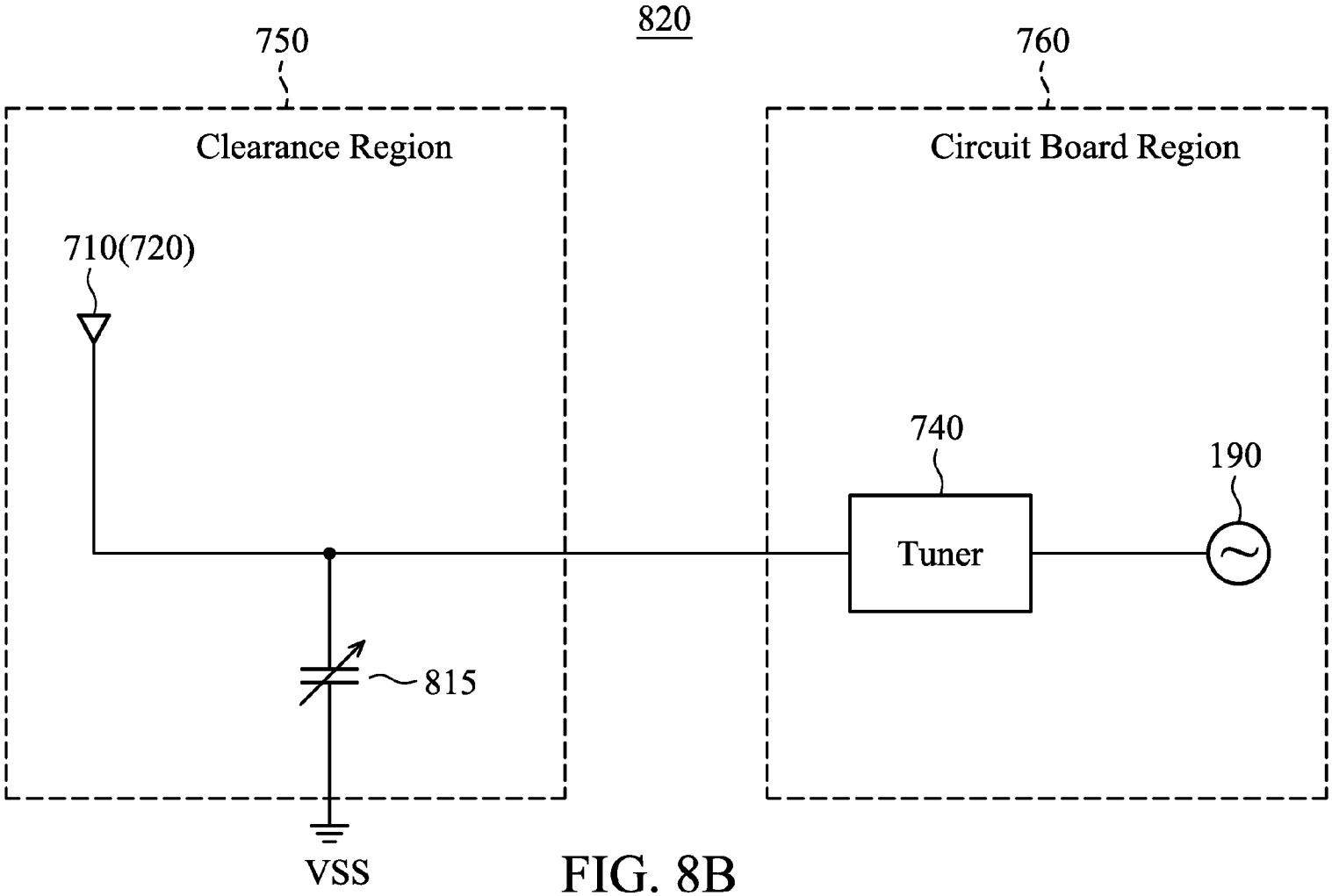
FIG. 8B is a diagram for illustrating a mobile device according to a ninth embodiment of the invention.

FIG. 8B is a diagram for illustrating a mobile device 820 according to a ninth embodiment of the invention. The mobile device 820 of the ninth embodiment is similar to the mobile device 700 of the seventh embodiment. In the mobile device 820, the aforementioned tunable circuit element 730 comprises a variable capacitor 815. A first terminal of the variable capacitor 815 is coupled to the radiation element 720 and the tuner 740, and a second terminal of the variable capacitor 815 is coupled to a ground voltage VSS. In some embodiments, the ground voltage VSS is provided by a ground plane (not shown) of the mobile device 820. By adjusting a capacitance of the variable capacitor 815 and/or the variable impedance value of the tuner 740, the antenna structure 710 of the mobile device 820 is excited and capable of generating multiple bands so as to achieve the desired wideband operation.

Figure 8C:
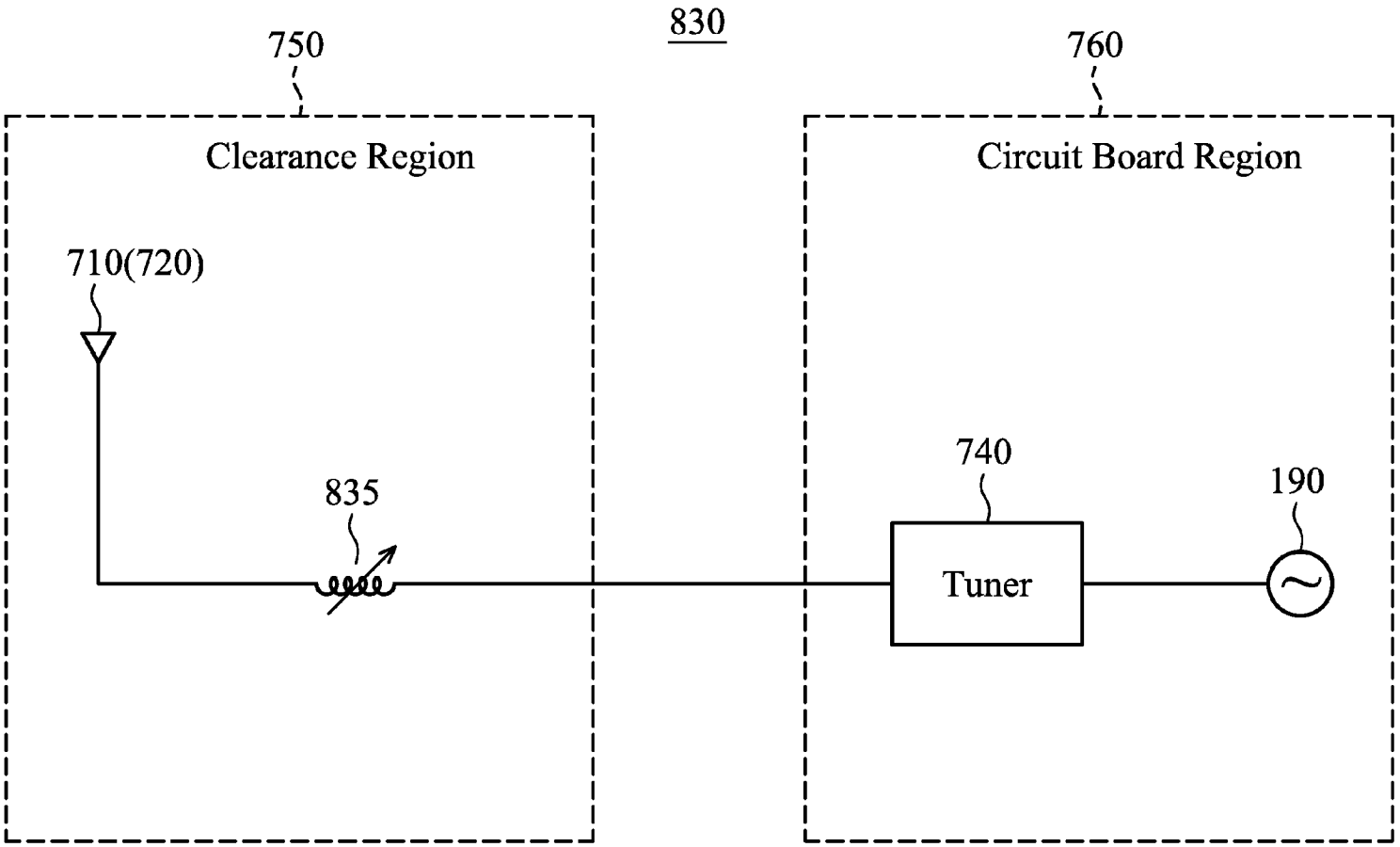
FIG. 8C is a diagram for illustrating a mobile device according to a tenth embodiment of the invention.

FIG. 8C is a diagram for illustrating a mobile device 830 according to a tenth embodiment of the invention. The mobile device 830 of the tenth embodiment is similar to the mobile device 700 of the seventh embodiment. In the mobile device 830, the aforementioned tunable circuit element 730 comprises a variable inductor 835. A first terminal of the variable inductor 835 is coupled to the radiation element 720, and a second terminal of the variable inductor 835 is coupled to the tuner 740. By adjusting an inductance of the variable inductor 835 and/or the variable impedance value of the tuner 740, the antenna structure 710 of the mobile device 830 is excited and capable of generating multiple bands so as to achieve the desired wideband operation.

Figure 8D:
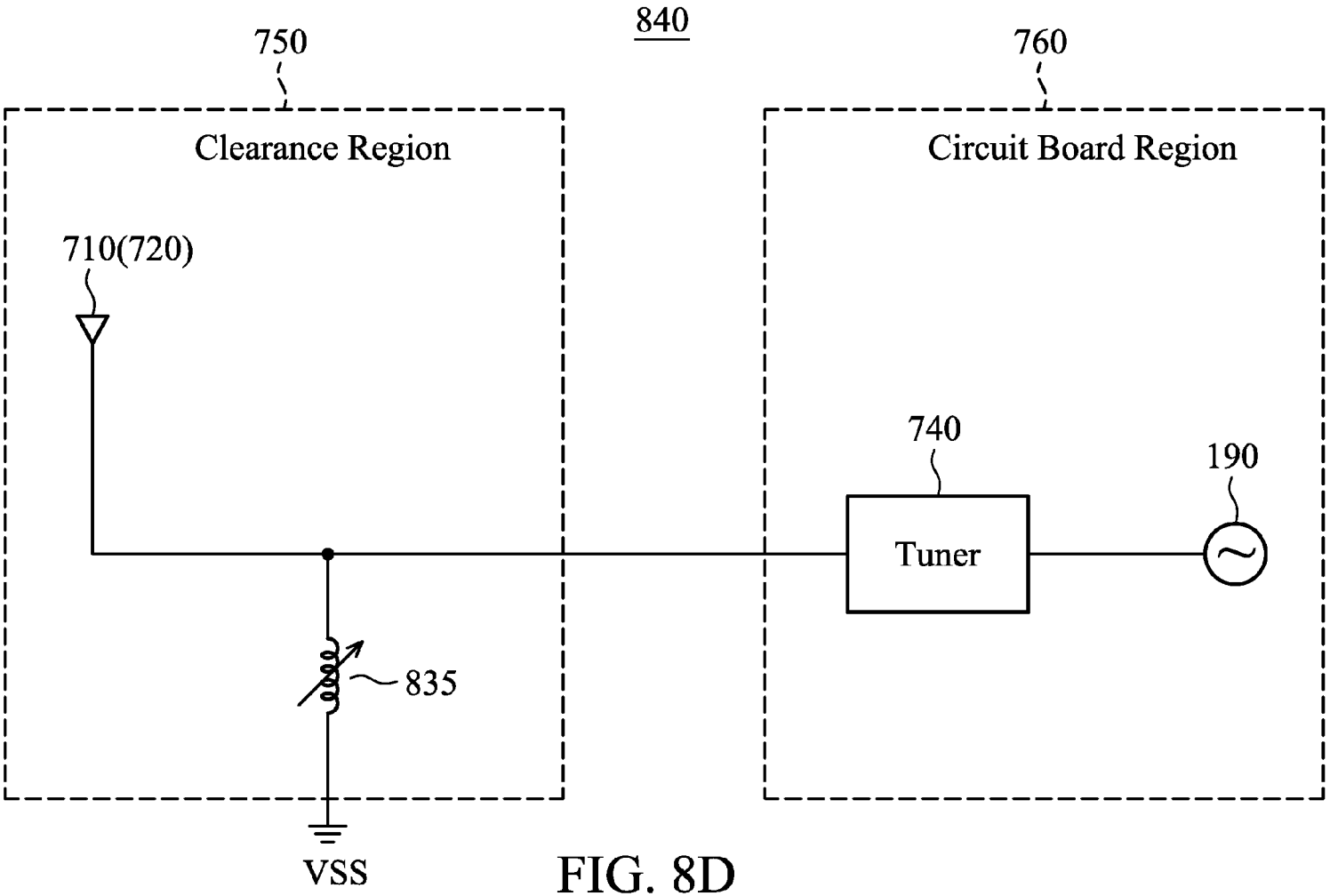
FIG. 8D is a diagram for illustrating a mobile device according to an eleventh embodiment of the invention.

FIG. 8D is a diagram for illustrating a mobile device 840 according to an eleventh embodiment of the invention. The mobile device 840 of the eleventh embodiment is similar to the mobile device 700 of the seventh embodiment. In the mobile device 840, the aforementioned tunable circuit element 730 comprises a variable inductor 835. A first terminal of the variable inductor 835 is coupled to the radiation element 720 and the tuner 740, and a second terminal of the variable inductor 835 is coupled to a ground voltage VSS. In some embodiments, the ground voltage VSS is provided by a ground plane (not shown) of the mobile device 840. By adjusting an inductance of the variable inductor 835 and/or the variable impedance value of the tuner 740, the antenna structure 710 of the mobile device 840 is excited and capable of generating multiple bands so as to achieve the desired wideband operation.

Figure 8E:
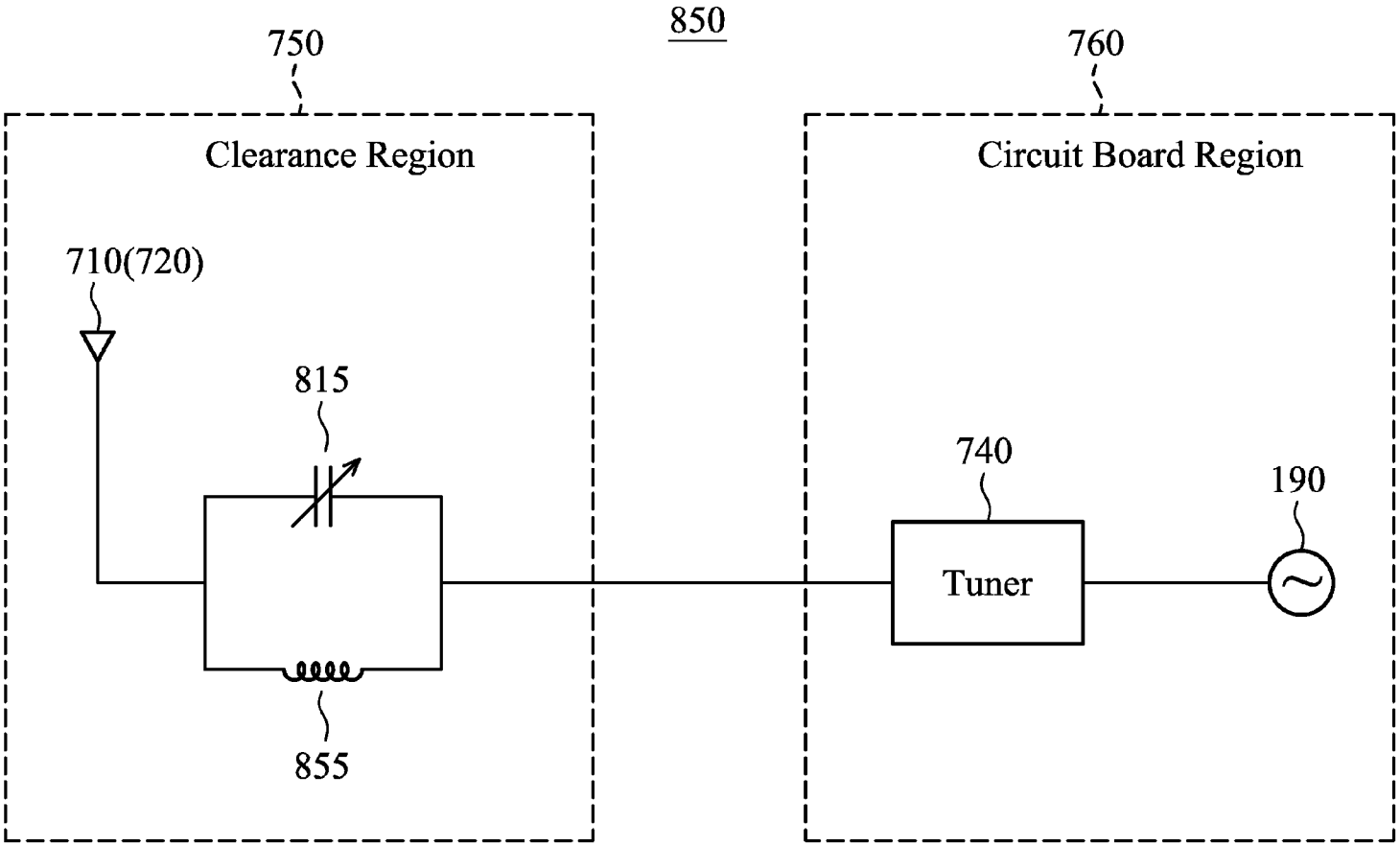
FIG. 8E is a diagram for illustrating a mobile device according to a twelfth embodiment of the invention.

FIG. 8E is a diagram for illustrating a mobile device 850 according to a twelfth embodiment of the invention. The mobile device 850 of the twelfth embodiment is similar to the mobile device 700 of the seventh embodiment. In the mobile device 850, the aforementioned tunable circuit element 730 comprises a variable capacitor 815 and an inductor 855. The inductor 855 may be a general inductor or a variable inductor. The variable capacitor 815 and the inductor 855 are coupled in parallel between the radiation element 720 and the tuner 740. By adjusting a capacitance of the variable capacitor 815 and/or the variable impedance value of the tuner 740, the antenna structure 710 of the mobile device 850 is excited and capable of generating multiple bands so as to achieve the desired wideband operation. If the inductor 855 is a variable inductor (not shown), its inductance is adjustable in the above process so as to achieve the desired wideband operation in a similar manner.

Figure 8F:
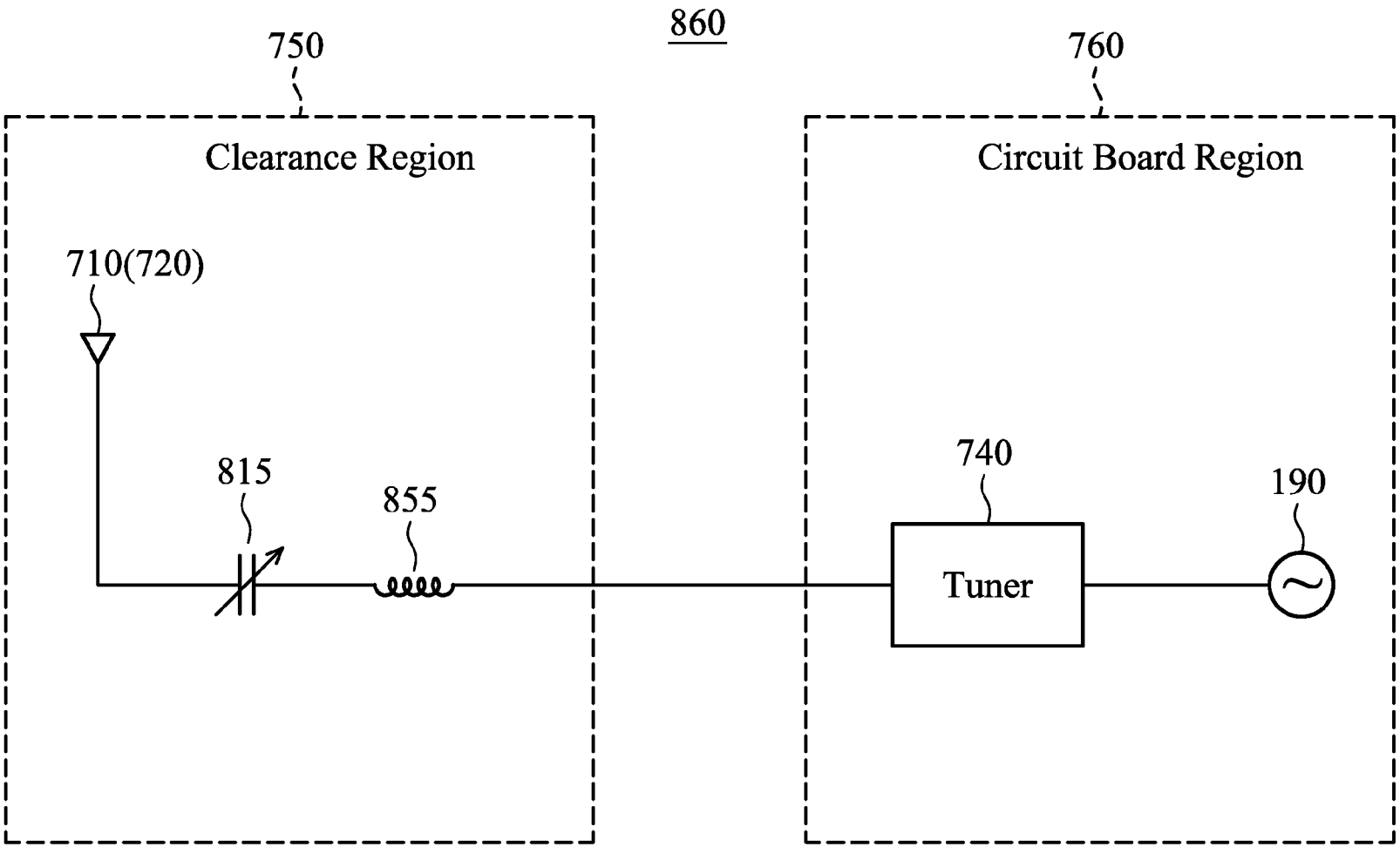
FIG. 8F is a diagram for illustrating a mobile device according to a thirteenth embodiment of the invention.

FIG. 8F is a diagram for illustrating a mobile device 860 according to a thirteenth embodiment of the invention. The mobile device 860 of the thirteenth embodiment is similar to the mobile device 700 of the seventh embodiment. In the mobile device 860, the aforementioned tunable circuit element 730 comprises a variable capacitor 815 and an inductor 855. The inductor 855 may be a general inductor or a variable inductor. The variable capacitor 815 and the inductor 855 are coupled in series between the radiation element 720 and the tuner 740. The position of the variable capacitor 815 may be interchanged with that of the inductor 855. By adjusting a capacitance of the variable capacitor 815 and/or the variable impedance value of the tuner 740, the antenna structure 710 of the mobile device 860 is excited and capable of generating multiple bands so as to achieve the desired wideband operation. If the inductor 855 is a variable inductor (not shown), its inductance is adjustable in the above process so as to achieve the desired wideband operation in a similar manner.

Figure 8G:
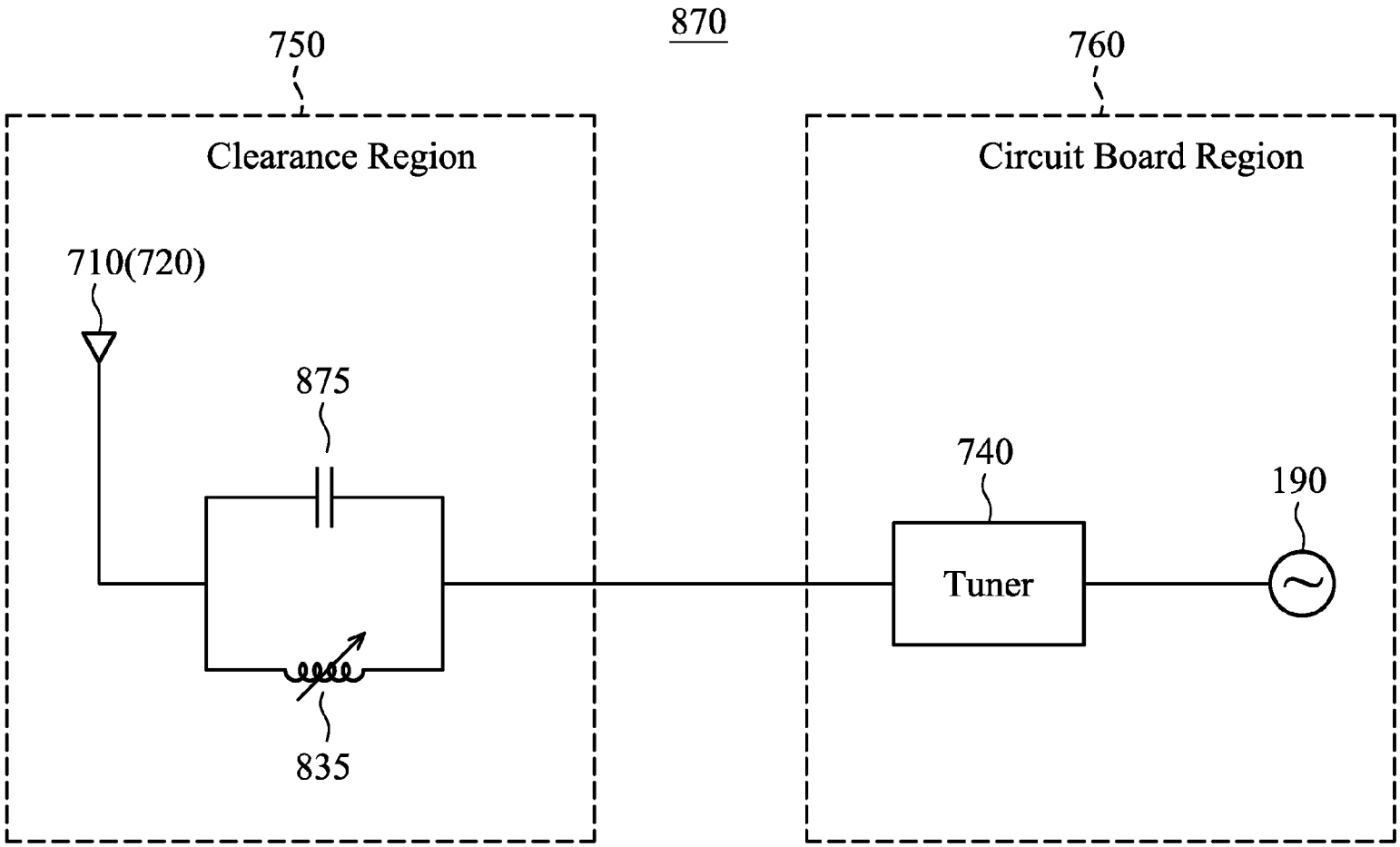
FIG. 8G is a diagram for illustrating a mobile device according to a fourteenth embodiment of the invention.

FIG. 8G is a diagram for illustrating a mobile device 870 according to a fourteenth embodiment of the invention. The mobile device 870 of the fourteenth embodiment is similar to the mobile device 700 of the seventh embodiment. In the mobile device 870, the aforementioned tunable circuit element 730 comprises a variable inductor 835 and a capacitor 875. The capacitor 875 may be a general capacitor or a variable capacitor. The variable inductor 835 and the capacitor 875 are coupled in parallel between the radiation element 720 and the tuner 740. By adjusting an inductance of the variable inductor 835 and/or the variable impedance value of the tuner 740, the antenna structure 710 of the mobile device 870 is excited and capable of generating multiple bands so as to achieve the desired wideband operation. If the capacitor 875 is a variable capacitor (not shown), its capacitance is adjustable in the above process so as to achieve the desired wideband operation in a similar manner.

Figure 8H:
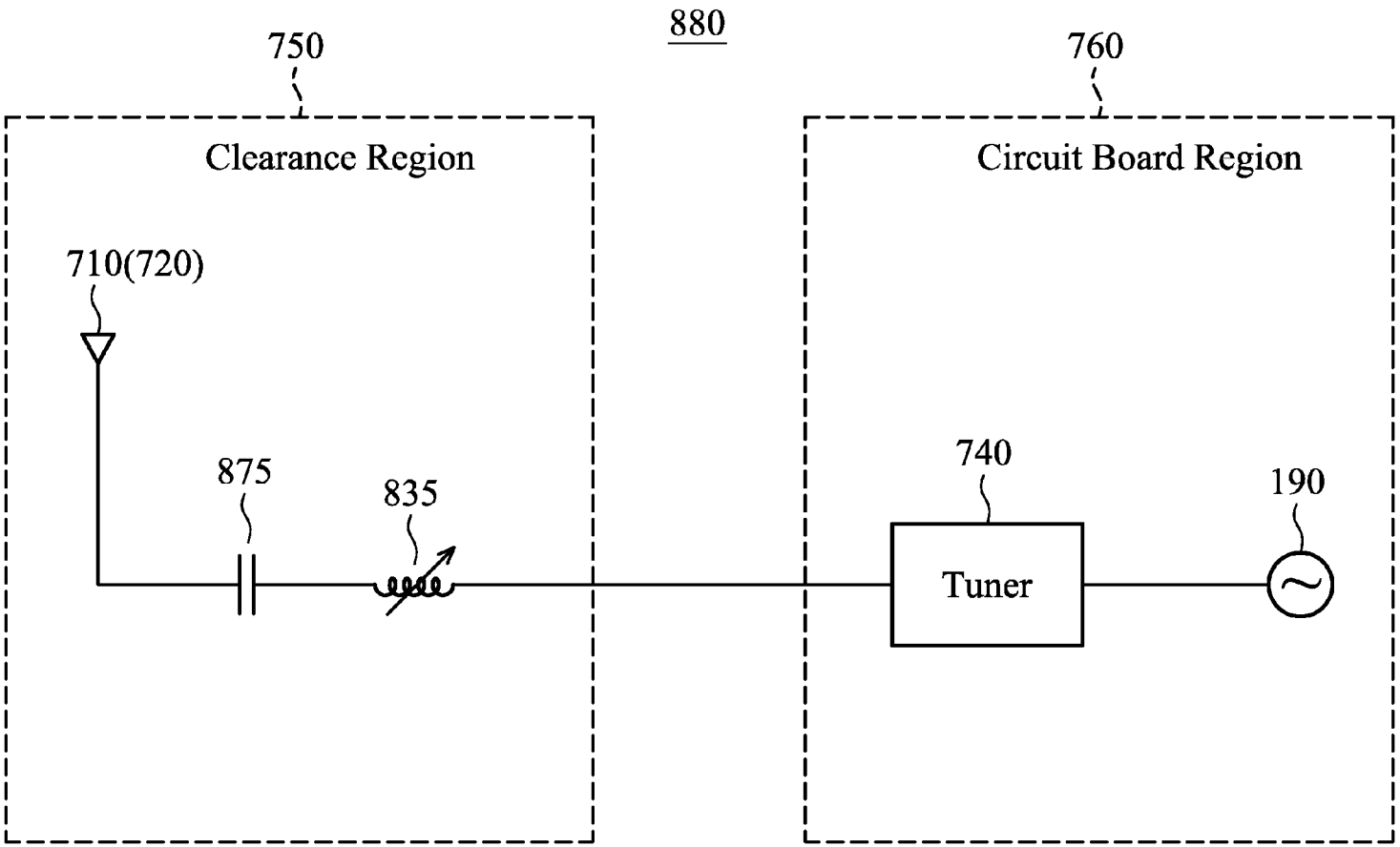
FIG. 8H is a diagram for illustrating a mobile device according to a fifteenth embodiment of the invention.

FIG. 8H is a diagram for illustrating a mobile device 880 according to a fifteenth embodiment of the invention. The mobile device 880 of the fifteenth embodiment is similar to the mobile device 700 of the seventh embodiment. In the mobile device 880, the aforementioned tunable circuit element 730 comprises a variable inductor 835 and a capacitor 875. The capacitor 875 may be a general capacitor or a variable capacitor. The variable inductor 835 and the capacitor 875 are coupled in series between the radiation element 720 and the tuner 740. The position of the variable inductor 835 may be interchanged with that of the capacitor 875. By adjusting an inductance of the variable inductor 835 and/or the variable impedance value of the tuner 740, the antenna structure 710 of the mobile device 880 is excited and capable of generating multiple bands so as to achieve the desired wideband operation. If the capacitor 875 is a variable capacitor (not shown), its capacitance is adjustable in the above process so as to achieve the desired wideband operation in a similar manner.

Figure 8I:
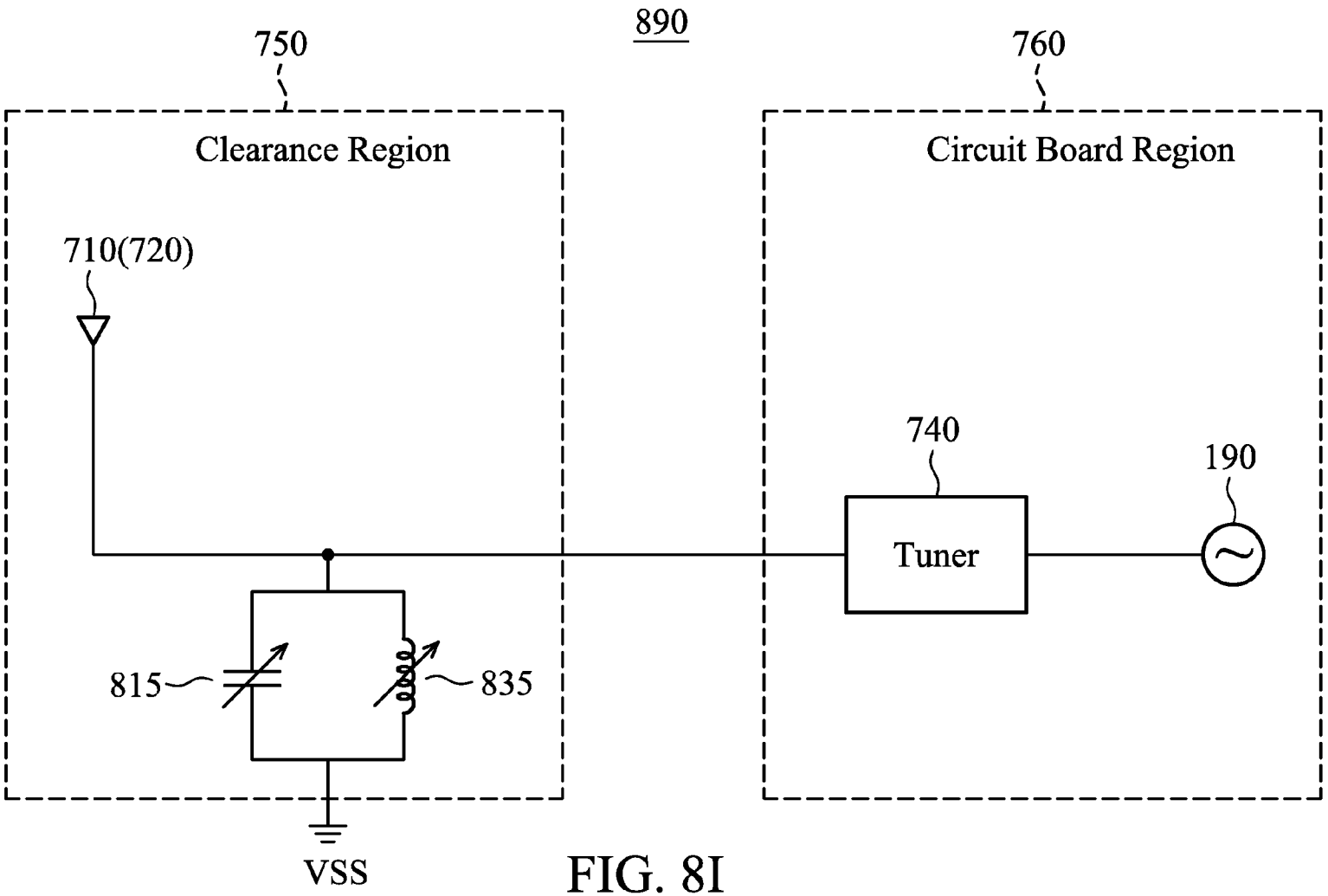
FIG. 8I is a diagram for illustrating a mobile device according to a sixteenth embodiment of the invention.

FIG. 8I is a diagram for illustrating a mobile device 890 according to a sixteenth embodiment of the invention. The mobile device 890 of the sixteenth embodiment is similar to the mobile device 700 of the seventh embodiment. In the mobile device 890, the aforementioned tunable circuit element 730 comprises a variable capacitor 815 and a variable inductor 835. A first terminal of the variable capacitor 815 is coupled to the radiation element 720 and the tuner 740, and a second terminal of the variable capacitor 815 is coupled to a ground voltage VSS. In some embodiments, the ground voltage VSS is provided by a ground plane (not shown) of the mobile device 890. Similarly, a first terminal of the variable inductor 835 is coupled to the radiation element 720 and the tuner 740, and a second terminal of the variable inductor 835 is coupled to the ground voltage VSS. In other words, the radiation element 720 is coupled through the variable capacitor 815 and the variable inductor 835, in parallel, to the ground voltage VSS. In some embodiments, the tunable circuit element 730 may be implemented in one of the following ways: (1) a variable capacitor 815 is coupled in parallel to an inductor 835 with a fixed inductance; (2) a capacitor 815 with a fixed capacitance is coupled in parallel to a variable inductor 835; and (3) a variable capacitor 815 is coupled in parallel to a variable inductor 835 (as shown in the embodiment of FIG. 8I). By adjusting a capacitance of the variable capacitor 815, an inductance of the variable inductor 835, and/or the variable impedance value of the tuner 740, the antenna structure 710 of the mobile device 890 is excited and capable of generating multiple bands so as to achieve the desired wideband operation.

Figure 8J:
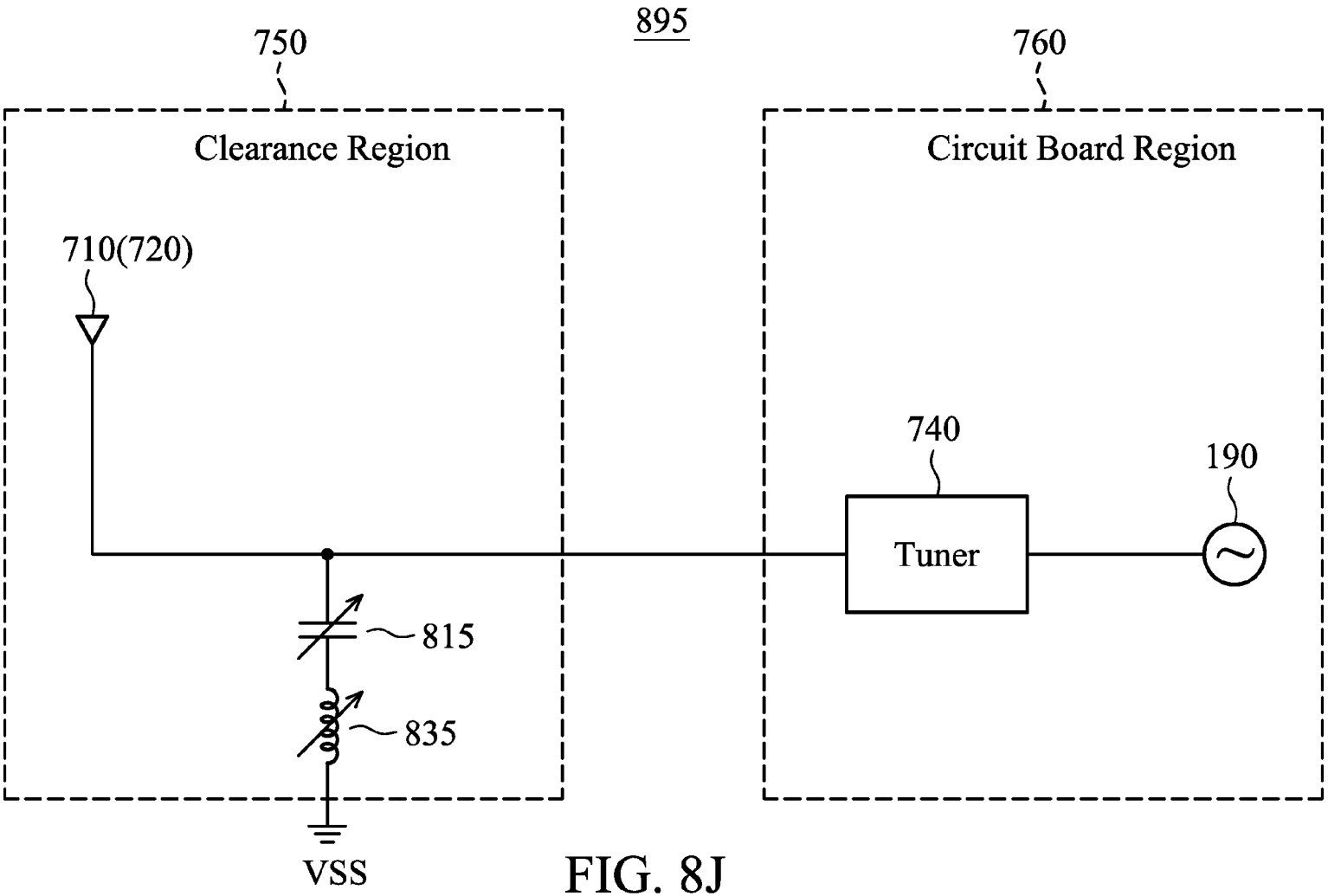
FIG. 8J is a diagram for illustrating a mobile device according to a seventeenth embodiment of the invention.

FIG. 8J is a diagram for illustrating a mobile device 895 according to a seventeenth embodiment of the invention. The mobile device 895 of the seventeenth embodiment is similar to the mobile device 700 of the seventh embodiment. In the mobile device 895, the aforementioned tunable circuit element 730 comprises a variable capacitor 815 and a variable inductor 835. A first terminal of the variable capacitor 815 is coupled to the radiation element 720 and the tuner 740, a second terminal of the variable capacitor 815 is coupled to a first terminal of the variable inductor 835, and a second terminal of the variable inductor 835 is coupled to a ground voltage VSS. In other words, the radiation element 720 is coupled through the variable capacitor 815 and the variable inductor 835, in series, to the ground voltage VSS. In some embodiments, the ground voltage VSS is provided by a ground plane (not shown) of the mobile device 895. In some embodiments, the position of the variable capacitor 815 may be interchanged with that of the variable inductor 835. In some embodiments, the tunable circuit element 730 may be implemented in one of the following ways: (1) a variable capacitor 815 is coupled in series to an inductor 835 with a fixed inductance; (2) a capacitor 815 with a fixed capacitance is coupled in series to a variable inductor 835; and (3) a variable capacitor 815 is coupled in series to a variable inductor 835 (as shown in the embodiment of FIG. 8J). By adjusting a capacitance of the variable capacitor 815, an inductance of the variable inductor 835, and/or the variable impedance value of the tuner 740, the antenna structure 710 of the mobile device 895 is excited and capable of generating multiple bands so as to achieve the desired wideband operation.

Figure 9A:
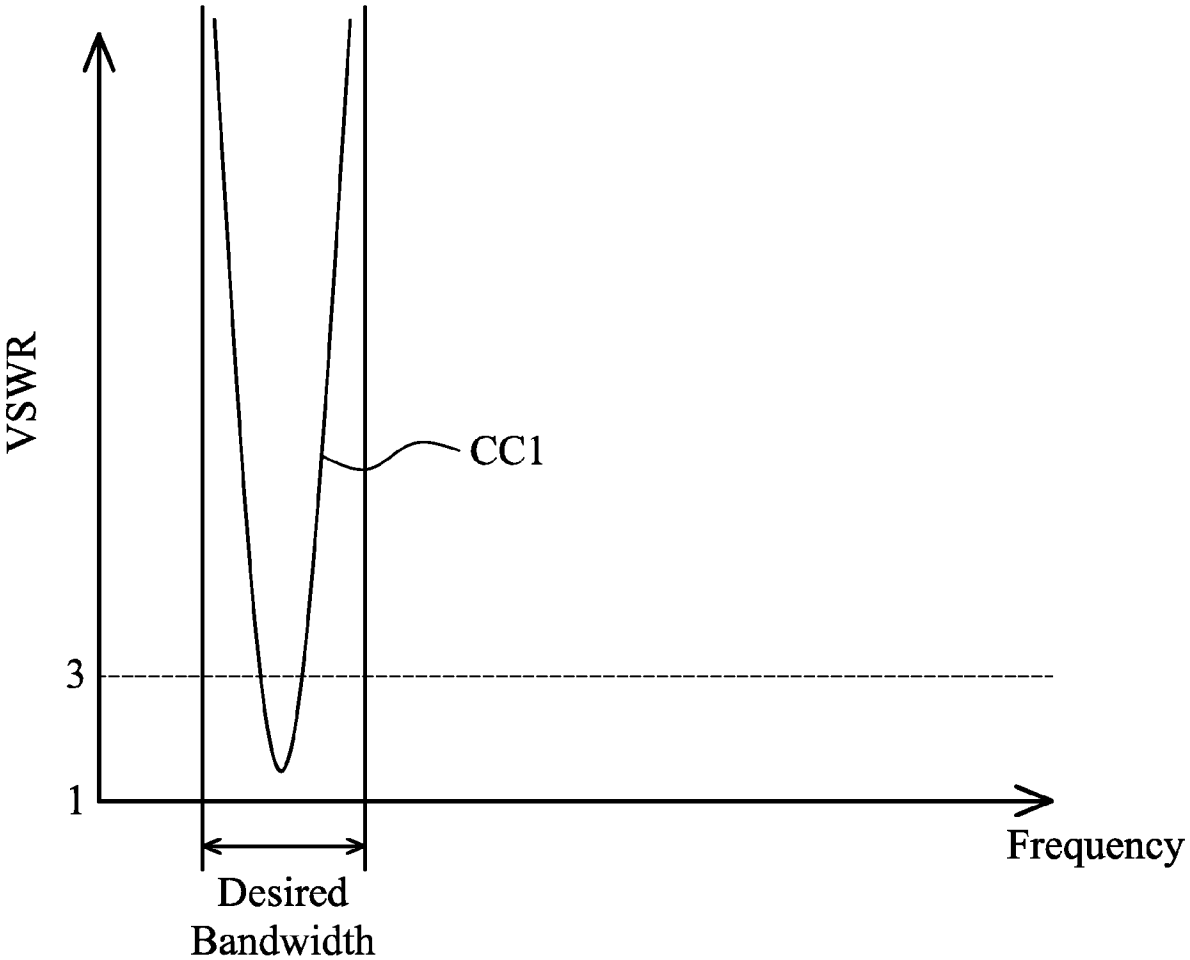
FIG. 9A is a diagram for illustrating a VSWR of the mobile device without the tunable circuit element and the tuner according to the seventh embodiment of the invention.

FIG. 9A is a diagram for illustrating a VSWR (Voltage Standing Wave Ratio) of the mobile device 700 without the tunable circuit element 730 and the tuner 740 according to the seventh embodiment of the invention. In this case, the curve CC1 represents the plot of VSWR versus frequency for the antenna structure 710. As shown in FIG. 9A, when the tunable circuit element 730 and the tuner 740 are both removed from the mobile device 700 and just a matching circuit is used (not shown), the antenna structure 710 of the mobile device 700 is merely capable of operating in a single band, without covering the desired bandwidth completely.

Figure 9B:
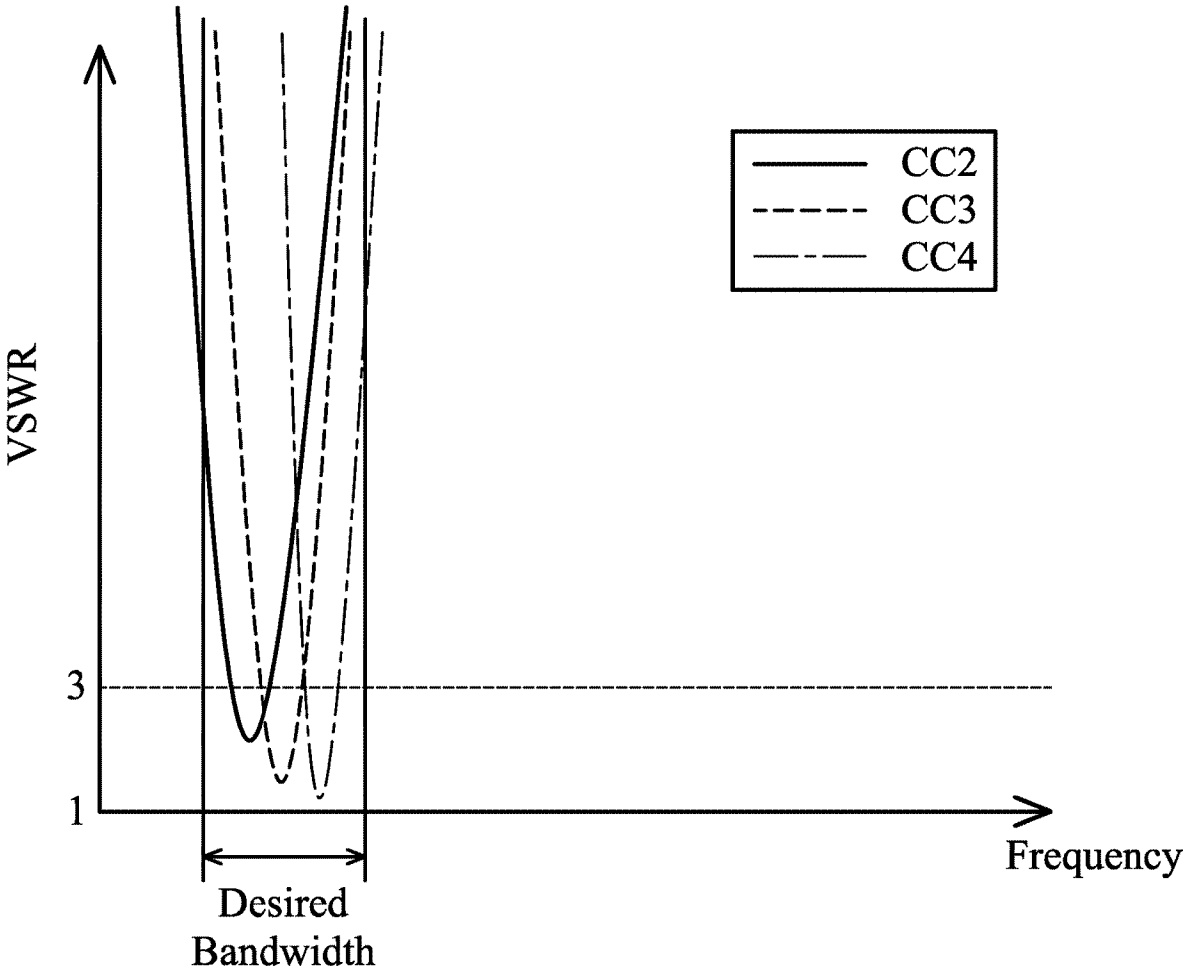
FIG. 9B is a diagram for illustrating a VSWR of the mobile device with the tunable circuit element but without the tuner according to the seventh embodiment of the invention.

FIG. 9B is a diagram for illustrating a VSWR of the mobile device 700 with the tunable circuit element 730 but without the tuner 740 according to the seventh embodiment of the invention. The curve CC2 represents the plot of VSWR versus frequency for the antenna structure 710 when the tunable circuit element 730 has a first capacitance and/or a first inductance. The curve CC3 represents the plot of VSWR versus frequency for the antenna structure 710 when the tunable circuit element 730 has a second capacitance and/or a second inductance. The curve CC4 represents the plot of VSWR versus frequency for the antenna structure 710 when the tunable circuit element 730 has a third capacitance and/or a third inductance. As shown in FIG. 9B, after the tunable circuit element 730 is incorporated into the mobile device 700, the antenna structure 700 of the mobile device 700 is capable of operating in multiple bands, which nearly cover the desired bandwidth.

Figure 9C:
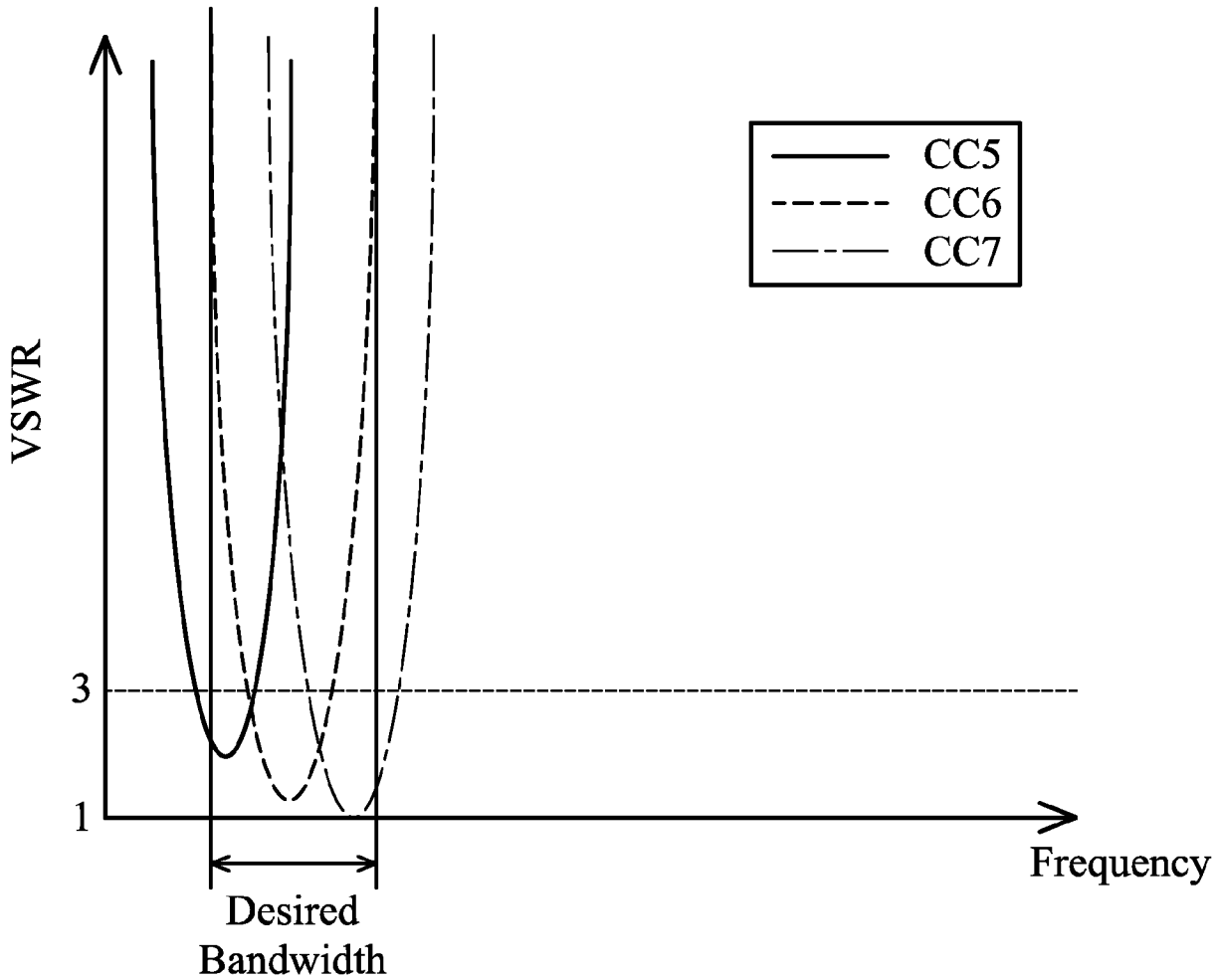
FIG. 9C is a diagram for illustrating a VSWR of the mobile device with the tunable circuit element and the tuner according to the seventh embodiment of the invention.

FIG. 9C is a diagram for illustrating a VSWR of the mobile device 700 with the tunable circuit element 730 and the tuner 740 according to the seventh embodiment of the invention. The curve CC5 represents the plot of VSWR versus frequency for the antenna structure 710 when the tunable circuit element 730 has the first capacitance and/or the first inductance and the tuner 740 provides the appropriate impedance matching. The curve CC6 represents the plot of VSWR versus frequency for the antenna structure 710 when the tunable circuit element 730 has the second capacitance and/or the second inductance and the tuner 740 provides the appropriate impedance matching. The curve CC7 represents the plot of VSWR versus frequency for the antenna structure 710 when the tunable circuit element 730 has the third capacitance and/or the third inductance and the tuner 740 provides the appropriate impedance matching. As shown in FIG. 9C, after the tunable circuit element 730 and the tuner 740 are both incorporated into the mobile device 700, the antenna structure 700 of the mobile device 700 is capable of operating in more bands, which cover the entire desired bandwidth.

The embodiments of FIGS. 7 and 8A-8J may be integrated with the embodiments of FIGS. 1-4. Please refer to the descriptions of the following paragraph and figures.

Figure 10A:
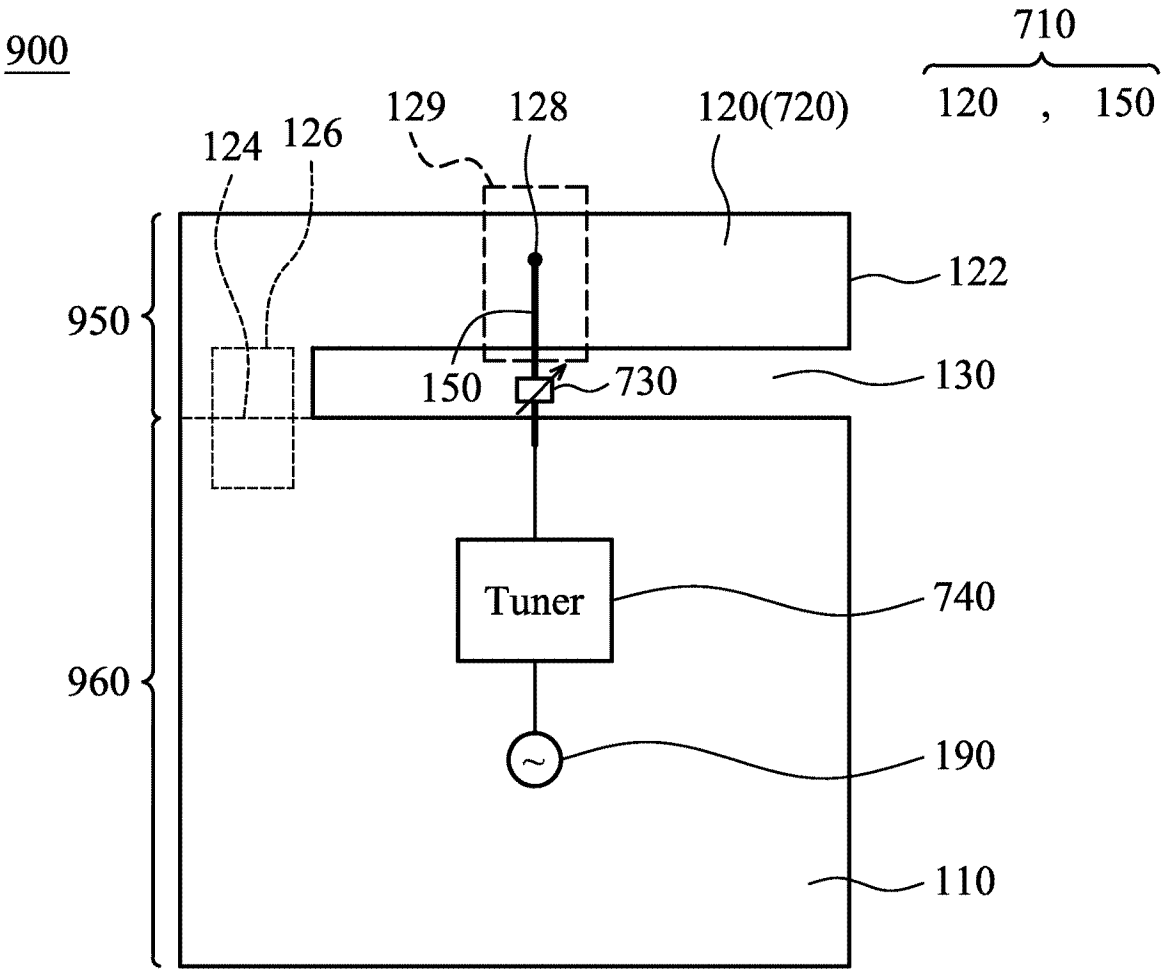
FIG. 10A is a diagram for illustrating a mobile device according to an eighteenth embodiment of the invention.

FIG. 10A is a diagram for illustrating a mobile device 900 according to an eighteenth embodiment of the invention. The mobile device 900 of the eighteenth embodiment is similar to the mobile device 100 of the first embodiment and the mobile device 700 of the seventh embodiment, and may be considered as a specific combination of both. As shown in FIG. 10A, the mobile device 900 at least comprises a ground plane 110, an antenna structure 710, a tunable circuit element 730, a tuner 740, and a signal source 190. The ground plane 110, the tuner 740, and the signal source 190 are disposed in a circuit board region 960 of the mobile device 900. The antenna structure 710 and the tunable circuit element 730 are disposed in a clearance region 950 of the mobile device 900. More particularly, the antenna structure 710 comprises a grounding branch 120 and a feeding element 150. The grounding branch 120 is coupled to the ground plane 110, and forms a radiation element 720. A slot 130 is formed between the ground plane 110 and the grounding branch 120. The feeding element 150 extends across the slot 130. The tunable circuit element 730 is embedded in the feeding element 150, and is coupled in series to the feeding element 150. In some embodiments, the tunable circuit element 730 at least comprises a variable capacitor, a variable inductor, or a combination of both. The tunable circuit element 730 may be disposed in the slot 130.

The signal source 190 is coupled through the tuner 740, the tunable circuit element 730, and the feeding element 150 to the grounding branch 120 (i.e., the radiation element 720) so as to excite the antenna structure 710 and generate multiple bands; alternatively, the signal source 190 is coupled through the tuner 740 and the feeding element 150 to the grounding branch 120, and the tunable circuit element 730 is coupled between the feeding element 150 and the ground plane 110.

For some of the above embodiments, the mobile device 900, for example, may further comprise one or more electronic components (not shown), such as a speaker, a camera, and/or a headphone jack. The one or more electronic components are disposed on the grounding branch 120 of the antenna structure 710 of the mobile device 900, and may be considered as a portion of the antenna structure 710. In other words, although the one or more electronic components or other components (e.g., the tunable circuit element 730) are disposed in the clearance region 950, they are disposed within the range of the antenna structure 710 and electrically connected to the antenna structure 710, and thus they may be considered as a portion of the antenna structure 710. Accordingly, the one or more electronic components do not affect the radiation performance of the antenna structure 710 very much. In the embodiment, the antenna structure 710 may load the electronic components and may be integrated therewith appropriately, thereby saving inner design space of the mobile device 900. Note that the electronic components are all coupled through a wiring region 126 to a processing module and a control module (not shown). In the mobile device 900 of the eighteenth embodiment, the configuration of the tunable circuit element 730 may correspond to the embodiments of FIGS. 8A, 8C, and 8E-8H. Note further that every detailed feature of the aforementioned embodiments of FIGS. 1-4, 7, 8A, 8C, and 8E-8H may be applied to the mobile device 900 of FIG. 10A, and those features will not be described again here.

Figure 10B:
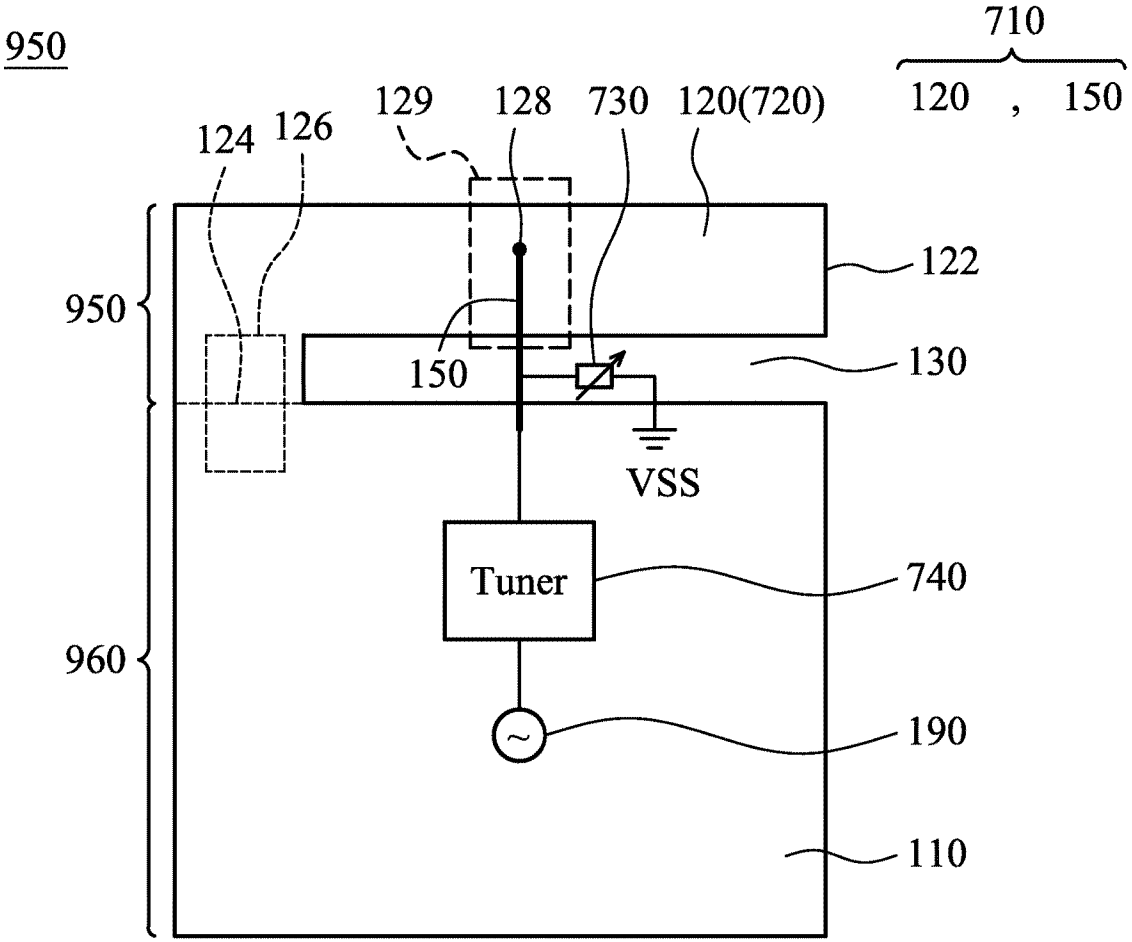
FIG. 10B is a diagram for illustrating a mobile device according to a nineteenth embodiment of the invention.

FIG. 10B is a diagram for illustrating a mobile device 950 according to a nineteenth embodiment of the invention. The mobile device 950 of the nineteenth embodiment is similar to the mobile device 900 of the eighteenth embodiment. The difference between the two embodiments is that the tunable circuit element 730 of the mobile device 950 is coupled between the feeding element 150 and the ground plane 110 (i.e., a first terminal of the tunable circuit element 730 is coupled to the feeding element 150, and a second terminal of the tunable circuit element 730 is coupled to the ground plane 110 or a ground voltage VSS), instead of being coupled in series to the feeding element 150. In the mobile device 950 of the nineteenth embodiment, the configuration of the tunable circuit element 730 may correspond to the embodiments of FIGS. 8B, 8D, 8I, and 8J. Note further that every detailed feature of the aforementioned embodiments of FIGS. 1-4, 7, 8B, 8D, 8I, and 8J may be applied to the mobile device 950 of FIG. 10B, and those features will not be described again here.

Note that the invention is not limited to the above. The above element sizes, element parameters and frequency ranges may be adjusted by a designer according to different desires. The mobile devices and the antenna structures therein, for all of the embodiments of the invention, have similar performances after being finely tuned, because they have been designed in similar ways.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for ordinal term) to distinguish the claim elements.

The embodiments of the disclosure are considered as exemplary only, not limitations. It will be apparent to those skilled in the art that various modifications and variations can be made in the invention. The true scope of the disclosed embodiments being indicated by the following claims and their equivalents.

What is claimed is:

1. A mobile device, comprising:

a processor, disposed in a circuit board region of the mobile device;

an antenna structure, comprising a radiation element;

a signal source;

a tunable circuit element, having a variable capacitance or inductance or a combination thereof, and electrically coupled to a single feeding point on the radiation element, wherein the single feeding point is fixed, and wherein the tunable circuit element is disposed in a clearance region of the mobile device; and a tuner, having a variable impedance value, and electrically coupled between the tunable circuit element and the signal source, wherein the tuner and the signal source are disposed in the circuit board region of the mobile device, wherein the processor is electrically coupled to the tunable circuit element and the tuner, such that the mobile device is capable of operating in different bands, wherein the mobile device further comprises:

a ground plane, disposed in the circuit board region of the mobile device, and wherein the antenna structure further comprises:

a grounding branch, electrically coupled to the ground plane, and forming at least a part of the radiation element, wherein a first slot and a second slot are formed between the ground plane and the grounding branch, such that the grounding branch substantially has a T-shape, and wherein the antenna structure further comprises:

a feeding element, extending across the whole first slot or the whole second slot, wherein the signal source is electrically coupled to the tuner, the tunable circuit element, the feeding element and the grounding branch.

2. The mobile device as claimed in claim 1, wherein the tunable circuit element comprises a variable capacitor, a first terminal of the variable capacitor is coupled to the radiation element, and a second terminal of the variable capacitor is coupled to the tuner.

3. The mobile device as claimed in claim 1, wherein the tunable circuit element comprises a variable inductor, a first terminal of the variable inductor is coupled to the radiation element, and a second terminal of the variable inductor is coupled to the tuner.

4. The mobile device as claimed in claim 1, wherein the tunable circuit element is embedded in the feeding element.

5. The mobile device as claimed in claim 1, wherein the tunable circuit element is coupled in series to the feeding element.

6. The mobile device as claimed in claim 1, further comprising:

a dielectric substrate, wherein the circuit board region and the ground plane are disposed on the dielectric substrate.

7. A mobile device, comprising:

a processor, disposed in a circuit board region of the mobile device;

an antenna structure, comprising a radiation element;

a signal source;

a tunable circuit element, having a variable capacitance or inductance or a combination thereof, and electrically coupled to a single feeding point on the radiation element, wherein the single feeding point is fixed, and wherein the tunable circuit element is disposed in a clearance region of the mobile device; and a tuner, having a variable impedance value, and electrically coupled between the tunable circuit element and the signal source, wherein the tuner and the signal source are disposed in the circuit board region of the mobile device, wherein the processor is electrically coupled to the tunable circuit element and the tuner, such that the mobile device is capable of operating in different bands, wherein the mobile device further comprises:

a ground plane, disposed in the circuit board region of the mobile device, and wherein the antenna structure further comprises:

a grounding branch, electrically coupled to the ground plane, and forming at least a part of the radiation element, wherein a first slot and a second slot are formed between the ground plane and the grounding branch, such that the grounding branch substantially has a T-shape, and wherein the antenna structure further comprises:

a feeding element, extending across the whole first slot or the whole second slot, wherein the signal source is electrically coupled to the tuner, the feeding element and the grounding branch, and wherein the tunable circuit element is coupled between the feeding element and the ground plane.

8. The mobile device as claimed in claim 7, wherein the tunable circuit element comprises a variable capacitor and an inductor, and the inductor and the variable capacitor are coupled in parallel or coupled in series between the radiation element and the tuner.

9. The mobile device as claimed in claim 7, wherein the tunable circuit element comprises a variable capacitor, a first terminal of the variable capacitor is coupled to the radiation element and the tuner, and a second terminal of the variable capacitor is coupled to a ground voltage.

10. The mobile device as claimed in claim 7, wherein the tunable circuit element comprises a variable inductor and a capacitor, and the capacitor and the variable inductor are coupled in parallel or coupled in series between the radiation element and the tuner.

11. The mobile device as claimed in claim 7, wherein the tunable circuit element comprises a variable inductor, a first terminal of the variable inductor is coupled to the radiation element and the tuner, and a second terminal of the variable inductor is coupled to a ground voltage.

12. The mobile device as claimed in claim 7, wherein the tunable circuit element comprises a variable capacitor and a variable inductor, a first terminal of the variable capacitor is coupled to the radiation element and the tuner, a second terminal of the variable capacitor is coupled to a ground voltage, a first terminal of the variable inductor is coupled to the radiation element and the tuner, and a second terminal of the variable inductor is coupled to the ground voltage.

13. The mobile device as claimed in claim 7, wherein the tunable circuit element comprises a variable capacitor and a variable inductor, a first terminal of the variable capacitor is coupled to the radiation element and the tuner, a second terminal of the variable capacitor is coupled to a first terminal of the variable inductor, and a second terminal of the variable inductor is coupled to a ground voltage.

* * * * *